US009162833B2

(12) United States Patent
Udagawa et al.

(10) Patent No.: US 9,162,833 B2
(45) Date of Patent: Oct. 20, 2015

(54) MEDIUM FEEDING APPARATUS AND IMAGE FORMING APPARATUS

(71) Applicant: Oki Data Corporation, Tokyo (JP)

(72) Inventors: Hiroshi Udagawa, Tokyo (JP); Makoto Kitamura, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 13/754,888

(22) Filed: Jan. 30, 2013

(65) Prior Publication Data

US 2013/0193636 A1 Aug. 1, 2013

(30) Foreign Application Priority Data

Jan. 31, 2012 (JP) ..... 2012-018905

(51) Int. Cl.
*B65H 1/00* (2006.01)
*B65H 1/26* (2006.01)

(52) U.S. Cl.
CPC ..... *B65H 1/266* (2013.01); *B65H 2405/121* (2013.01); *B65H 2511/12* (2013.01); *B65H 2511/22* (2013.01)
USPC ..... 271/171; 271/240

(58) Field of Classification Search
CPC ..... B65H 1/04; B65H 2511/10; B65H 1/266; B65H 11/12; B65H 2405/121; B65H 2405/11425; B65H 2405/1144
USPC ..... 271/171, 240, 145
See application file for complete search history.

(56) References Cited

U.S. PATENT DOCUMENTS

| | | | | |
|---|---|---|---|---|
| 5,611,528 | A * | 3/1997 | Nakamura et al. | 271/164 |
| 8,113,506 | B2 * | 2/2012 | Kaseda | 271/171 |
| 8,469,352 | B2 * | 6/2013 | Kunioka | 271/3.14 |
| 2006/0113725 | A1 * | 6/2006 | Ito | 271/171 |

FOREIGN PATENT DOCUMENTS

| | | | | |
|---|---|---|---|---|
| JP | 04323141 | A * | 11/1992 | B65H 3/54 |
| JP | 06-329272 | | 11/1994 | |
| JP | H09-110193 | A | 4/1997 | |
| JP | 2008-081259 | A | 4/2008 | |

* cited by examiner

*Primary Examiner* — Prasad Gokhale
(74) *Attorney, Agent, or Firm* — Rabin & Berdo, P.C.

(57) ABSTRACT

A medium feeding apparatus includes an apparatus main body, and a medium cassette removably inserted into the apparatus main body. The medium cassette is configured to store a medium. The medium cassette includes a medium positioning unit for determining a position of the medium, and a locking unit that locks a movement of the medium positioning unit when the medium cassette is inserted into the apparatus main body and before the medium cassette reaches a predetermined position in the apparatus main body.

20 Claims, 26 Drawing Sheets

MEDIUM FEEDING APPARATUS AND IMAGE FORMING APPARATUS

BACKGROUND OF THE INVENTION

The present invention relates to a medium feeding apparatus provided in an image forming apparatus or the like.

In an image forming apparatus such as a copier, a printer, a facsimile or the like, an exposure unit such as a laser scanning unit or an LED (light emitting diode) emits light to expose a surface of a photosensitive body (i.e., an image bearing body) based on a image data to form a latent image. The latent image is developed with toner. The resulting toner image is transferred directly or via an intermediate transfer body to a medium such as a printing sheet or a film. The medium is conveyed to a fixing unit, where the toner image is fixed to the medium by application of heat and pressure.

Such an image forming apparatus includes a medium feeding apparatus for storing and feeding the medium. The medium feeding apparatus has a medium cassette in which a stack of the media (i.e., printing sheets) is stored. The medium cassette is detachably mounted to a main body of the medium feeding apparatus. The medium cassette has a pair of medium guides that determine positions of both ends of the media in a widthwise direction. Both medium guides have guide racks that engage a common pinion gear (see, for example, Japanese Laid-open Patent Publication No. 2008-81259 (FIG. 1)).

In this regard, when the medium cassette is mounted to the main body of the medium feeding apparatus, there is a possibility that the medium guides may be unintentionally displaced. In such a case, the medium (guided by the medium guides) may also be displaced.

SUMMARY OF THE INVENTION

An aspect of the present invention is intended to provide a medium feeding apparatus and an image forming apparatus capable of enhancing positioning accuracy of a medium stored in a medium cassette.

According to an aspect of the present invention, there is provided a medium feeding apparatus including an apparatus main body, and a medium cassette removably inserted into the apparatus main body. The medium cassette is configured to store a medium. The medium cassette includes a medium positioning unit for determining a position of the medium, and a locking unit that locks a movement of the medium positioning unit when the medium cassette is inserted into the apparatus main body and before the medium cassette reaches a predetermined position in the apparatus main body.

Since the movement of the medium positioning unit is locked by the locking unit while the medium cassette is mounted to the apparatus main body, the medium positioning unit can be prevented from being displaced. Therefore, positioning accuracy of the medium can be enhanced.

According to another aspect of the present invention, there is provided an image forming apparatus including a fan having an impeller. The fan further has a first side and a second side opposite to each other. The image forming apparatus further includes a frame to which the fan is mounted in a predetermined orientation so that the first side of the fan faces the frame. The frame has a ventilation opening facing the impeller. A resilient member is provided on the frame so as to face the fan. The fan has a supporting member on the first side, and an opening on the second side. The supporting member faces the resilient member.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. In the embodiments described below, descriptions will be given to a case where a medium cassette is inserted in a direction perpendicular to a medium feeding direction. In other words, descriptions will be given to a case where a movable direction of a medium guide is parallel to a mounting/detaching direction (i.e., an insertion/removal direction) of the medium cassette.

First Embodiment.

Figure 1:
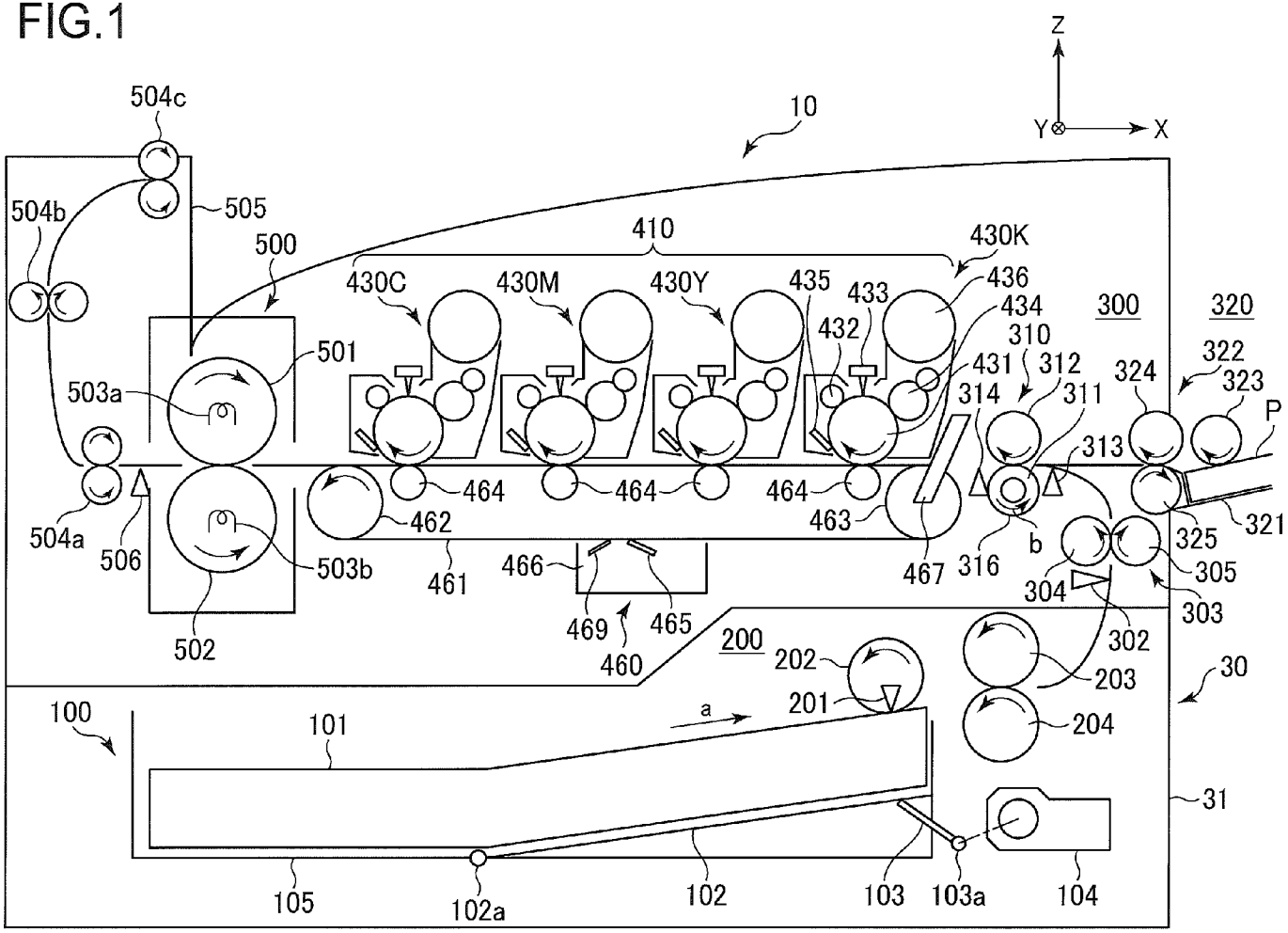
FIG. 1 is a schematic view showing a configuration of an image forming apparatus including a medium feeding apparatus according to the first embodiment of the present invention.

FIG. 1 is a schematic view showing a printer 10 as an image forming apparatus including a medium feeding apparatus 30 according to the first embodiment. The printer 10 shown in FIG. 1 includes the medium feeding apparatus 30 configured to feed a medium 101 such as a printing sheet, and an image forming portion 410 configured to form an image on the medium 101 fed by the medium feeding apparatus 30.

The medium feeding apparatus 30 includes a medium cassette 100 storing a plurality of media (i.e., printing sheets) 101, and a pickup-and-feeding unit 200 that picks up the media 101 one by one and feeds each medium 101 into a medium feeding path. The pickup-and-feeding unit 200 and a main body of the printer 10 has a continuous medium feeding path, so that the medium 101 can be smoothly fed from the pickup-and-feeding unit 200 to the main body of the printer 10 without causing a paper jam.

The medium feeding apparatus 30 and the main body of the printer 10 are connected using connectors for transmitting and receiving electric signal or the like.

The medium cassette 100 is removably inserted (i.e., detachably mounted) into a main body (i.e., an apparatus main body) 31 of the medium feeding apparatus 30. The medium cassette 100 includes a medium tray 105 for storing the media 101. The medium tray 105 has a placing plate 102 swingably supported by a shaft 102*a*. A stack of the media 101 is placed on the placing plate 102.

A swingable lift-up lever 103 is provided on a feeding side (i.e., a right side in FIG. 1) of the medium cassette 100. The lift-up lever 103 is mounted to a swinging shaft 103*a*. The swinging shaft 103*a* is disconnectably connected to a motor 104 provided in the main body of the printer 10. The lift-up lever 103 is connected to the motor 104 when the medium cassette 100 is inserted into the main body 31 of the medium feeding apparatus 30. The motor 104 is driven by a control unit 600 (FIG. 8) described later. The motor 104 causes the lift-up lever 103 to swing upward, and an end of the lift-up lever 103 pushes the placing plate 102 upward. As the placing plate 102 is pushed upward, the stack of the media 101 placed on the placing plate 102 moves upward.

A pickup roller 202 is disposed at a position where the pickup roller 202 contacts an upper surface of the stacked media 101 placed on the placing plate 102 pushed upward by the lift-up lever 103. Further, an upward movement detector 102 is provided for detecting that the stacked media 101 reach a height where the upper surface of the media 101 contacts the pickup roller 202.

When the upward movement detector 102 detects that the stacked media 101 reach the height where the upper surface of the stacked media 101 contacts the pickup roller 202, the control unit 600 (FIG. 8) causes the motor 104 to stop rotation. The pickup roller 202 is driven by a feed motor 711 (FIG. 8) to rotate in a direction shown by an arrow, and draws the medium 101 in a direction shown by an arrow "a" in FIG. 1.

A feed roller 203 and a retard roller 204 are provided on a feeding side (i.e., a right side in FIG. 1) of the pickup roller 202. The feed roller 203 and the retard roller 204 contact each other. The feed roller 203 is driven by the feed motor 711 (FIG. 8) together with the pickup roller 202 to rotate in a direction shown by an arrow. The retard roller 204 generates a force in a direction shown by an arrow by means of a torque-generator (not shown).

The feed roller 203 and the retard roller 204 separate the media 101 (drawn by the pickup roller 202) into each single medium 101. The pickup roller 202, the feed roller 203 and the retard roller 204 constitute the pickup-and-feeding unit 200.

A pair of conveying rollers 303 and another pair of conveying rollers 310 are provided on a downstream side of the pickup-and-feeding unit 200 in a feeding direction of the medium 101. The conveying rollers 303 convey the medium 101 while correcting a skew of the medium 101. The conveying rollers 304 convey the medium 101 to the image forming portion 410. The conveying rollers 303 include a driving roller 304 and a driven roller 305. The conveying rollers 310 include a driving roller 311 and a driven roller 312.

A passage sensor 302 is provided on an upstream side of the conveying rollers 303. Another passage sensor 313 is provided on an upstream side of the conveying rollers 311. The passage sensors 302 and 313 detect passage of the medium 101. A writing sensor 314 is provided on a downstream side of the conveying rollers 303. The wiring sensor 314 detects passage of the medium 101 for determining timing to start exposure (i.e., writing) in the image forming portion 410.

Figure 8:
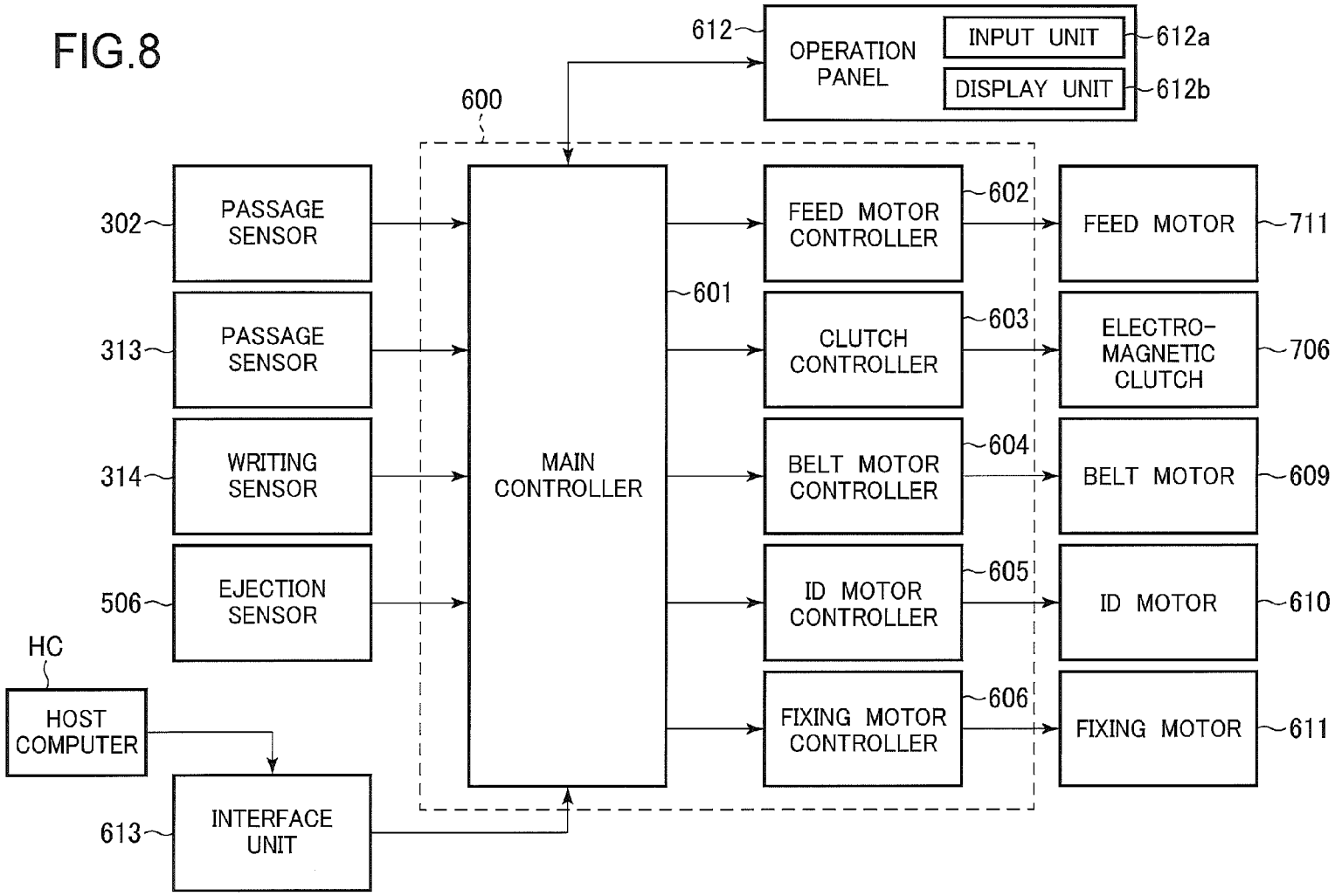
FIG. 8 is a block diagram showing a control system of the image forming apparatus according to the first embodiment.

A rotation of the feed motor 711 (FIG. 8) is transmitted to the conveying rollers 303 and 310 via a not shown transmitting mechanism. Rotations of the conveying rollers 303 and 310 are controlled by a feed motor controller 620 (FIG. 8).

Further, an MPT (Multi-Purpose Tray) 320 is swingably provided on a side surface (i.e., a right surface in FIG. 1) of the printer 10. The MPT 320 includes a placing plate 321 on which a stack of media P is placed. The placing plate 321 is swingably supported by a not shown supporting shaft.

The MPT 320 further includes a pickup roller 323 for picking up the medium P from the stack placed on the placing plate 321. The placing plate 321 is pushed upward by a not shown spring provided on a bottom of the placing plate 321. An upper surface of the stacked media P on the placing plate 321 contacts the pickup roller 323. The pickup roller 323 is driven by the feed motor 711 (FIG. 8) to rotate in a direction shown by an arrow, and feeds the medium P into the main body of the printer 10.

An MPT roller 324 and a retard roller 325 are provided on a feeding side (i.e., a left side in FIG. 1) of the pickup roller 323. The MPT roller 324 and the retard roller 325 contact each other. The MPT roller 324 is driven by the feed motor 711 (FIG. 8) to rotate in a direction shown by an arrow. The retard roller 325 generates a torque in a direction shown by an arrow by means of a torque generator (not shown).

The MPT roller 324 and the retard roller 325 separate the media P (drawn by the pickup roller 323) into each single medium P, and feed the medium P toward the conveying rollers 310 in the main body of the printer 10. The pickup roller 323, the MPT roller 324 and the retard roller 325 constitute a MPT pickup-and-feeding unit 322.

The image forming portion 410 of the printer 10 includes a process units (i.e., image forming units) 430K, 430Y, 430M and 430C that respectively form images of black, yellow, magenta and cyan. The process units 430K, 430Y, 430M and 430C are arranged in this order from an upstream side toward a downstream side along the feeding direction of the medium 101. Each of the process units 430K, 430Y, 430M and 430C is detachably mounted to the main body of the printer 10.

Here, a configuration of the process unit 430K will be described. The process unit 430K includes a photosensitive drum 431 as a latent image bearing body. The photosensitive drum 431 has a cylindrical shape and is rotatable in a direction shown by an arrow. The photosensitive drum 431 has a surface capable of holding an electric charge to bear a latent image.

Along a circumference of the photosensitive drum 431, a charging roller 432, an exposure device 433, a developing roller 434 and a cleaning blade 435 are provided in this order in a rotational direction of the photosensitive drum 431. The charging roller (i.e., a charging member) 432 is configured to uniformly charge the surface of the photosensitive drum 431. The exposure device 433 is configured to selectively emit light to the surface of the photosensitive drum 431 to thereby form a latent image. The developing roller (i.e., a developer bearing body) 434 is configured to develop the latent image on the surface of the photosensitive drum 431 using a black toner (i.e., a developer). The cleaning member 435 is configured to remove a residual toner that remains on the surface of the photosensitive drum 431.

The charging roller 432 is applied with a charging voltage for uniformly charging the surface of the photosensitive drum 431. The charging roller 432 rotates contacting the surface of the photosensitive drum 431. The exposure device 433 is provided above the photosensitive drum 431. The exposure device 433 emits light to the surface of the photosensitive drum 431 based on image data to thereby form a latent image. The developing roller 434 is applied with a developing voltage for causing the toner to adhere to the surface of the developing roller 434. The developing roller 434 rotates contacting the surface of the photosensitive drum 431.

A rotation of the ID motor 610 (FIG. 8) is transmitted to the photosensitive drum 431 and the developing roller 434. The charging roller 432 rotates following the rotation of the photosensitive drum 431 by contact with the photosensitive drum 431. A toner storage unit 436 (for example, a toner cartridge) is provided on an upper part of the process unit 430K. The toner storage unit 436 stores the toner therein, and supplies the toner to the developing roller 434.

The process units 430Y, 430M and 430C have the same configurations as that of the process unit 430K except the toner.

A transfer unit 460 is provided below the process units 430K, 430Y, 430M and 430C. The transfer unit 460 includes four transfer rollers 464 (i.e., transfer members) respectively pressed against the photosensitive drums 431 of the process units 430K, 430Y, 430M and 430C. Each transfer roller 464 includes a roller portion made of conductive rubber or the like. Each transfer roller 464 is applied with a transfer voltage, so as to create a potential difference between a surface potential of the transfer roller 464 and a surface potential of the photosensitive drum 431. The potential difference is for transferring the toner image to the medium 101.

A transfer belt 461 is provided through between the respective photosensitive drums 431 and the transfer rollers 464. The transfer belt 461 is stretched around a driving roller 462 and a tension roller 463. The driving roller 462 is driven by a belt motor 609 (FIG. 8) to rotate. The tension roller 463 applies tension to the transfer belt 461. As the driving roller 462 rotates, the transfer belt 461 conveys the medium 101 while holding the medium 101 by adsorption.

A cleaning blade 465 and a toner box 466 are provided below the transfer belt 461. The cleaning blade 465 scrapes off (i.e., removes) the toner adhering to the surface of the transfer belt 461. The toner box 466 stores the scraped-off toner. A film 469 is provided on an upstream side of the cleaning blade 465 in a moving direction of the transfer belt 461. The film 469 is provided so as to contact the transfer belt 461 for preventing the toner from scattering outside the toner box 466.

A fixing unit 500 is provided on a downstream side of the image forming portion 410 in the feeding direction of the medium 101. The fixing unit 500 includes an upper roller 501 and a lower roller 502. The upper roller 501 has a halogen lamp 503*a* therein as a heat source. A surface layer of the upper roller 501 is made of a resilient body. The lower roller 502 has a halogen lamp 503*b* therein as a heat source. A surface layer of the lower roller 502 is made of a resilient body. The upper roller 501 and the lower roller 502 of the fixing unit 500 apply heat and pressure to the toner image on the medium 101 (fed from the image forming portion 410) to thereby cause the toner to be molten and fixed to the medium 101.

Ejection rollers 504*a*, 504*b* and 504*c* are provided on a downstream side of the fixing unit 500 in the feeding direction of the medium 101. The ejection rollers 504*a*, 504*b* and 504*c* are configured to eject the medium 101 to which the toner image is fixed by the fixing unit 500. A stacker portion 505 is provided on an upper cover of the printer 10. The ejected medium 101 is placed on the stacker portion 505. An ejection sensor 506 is provided on an upstream side of the ejection rollers 504*a*, 504*b* and 504*c*. The ejection sensor 506 detects passage of the medium 101 for determining timings to start rotating the ejection rollers 504*a*, 504*b* and 504*c*.

Electromagnetic clutches (i.e., electromagnetic clutches 706 show in FIG. 8) are mounted to shafts of the feed roller 203, the driving roller 305, the driving roller 311 and the MPT roller 324 for transmitting driving forces to the respective rollers.

Figure 2:
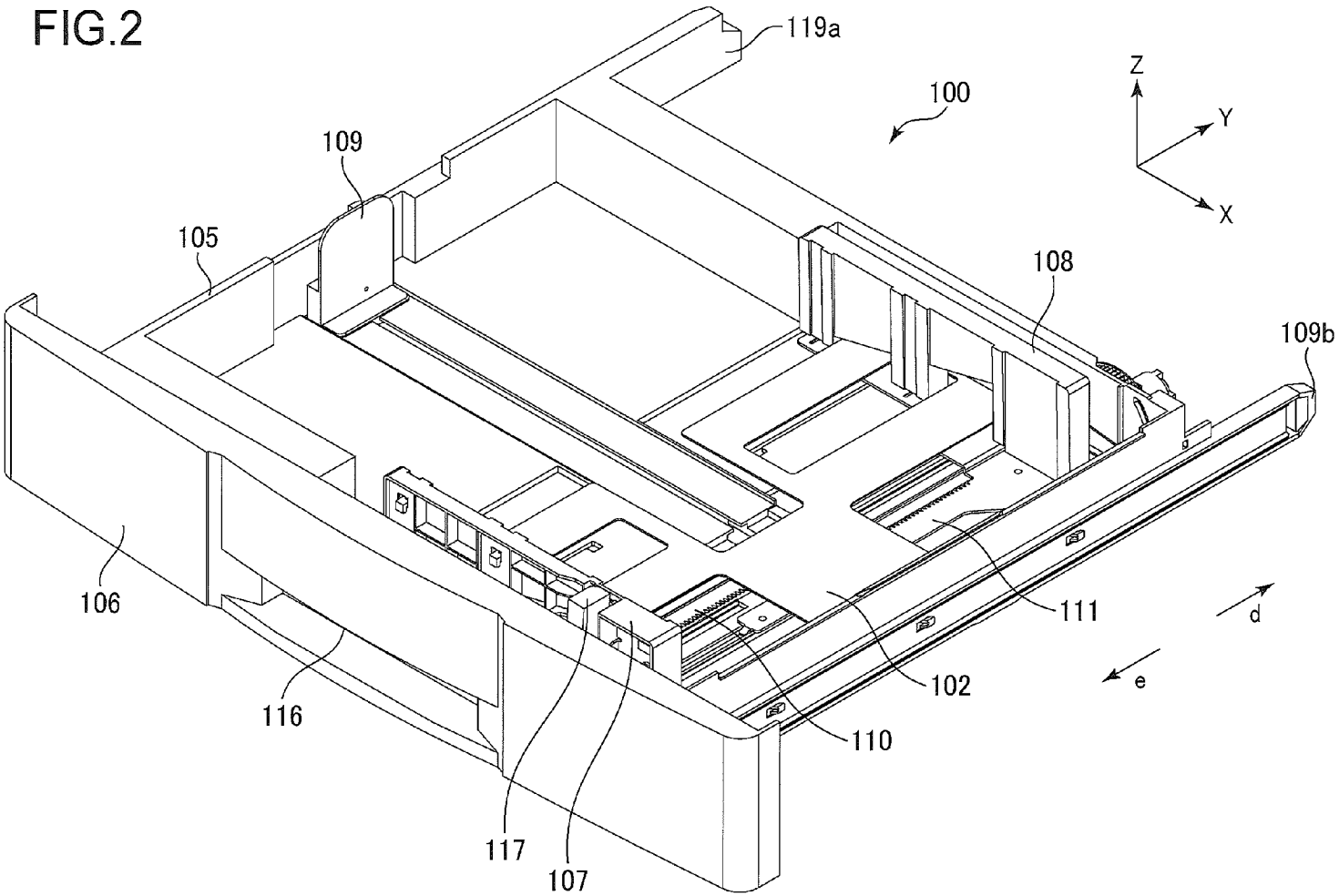
FIG. 2 is a perspective view showing a medium cassette according to the first embodiment.
Figure 3:
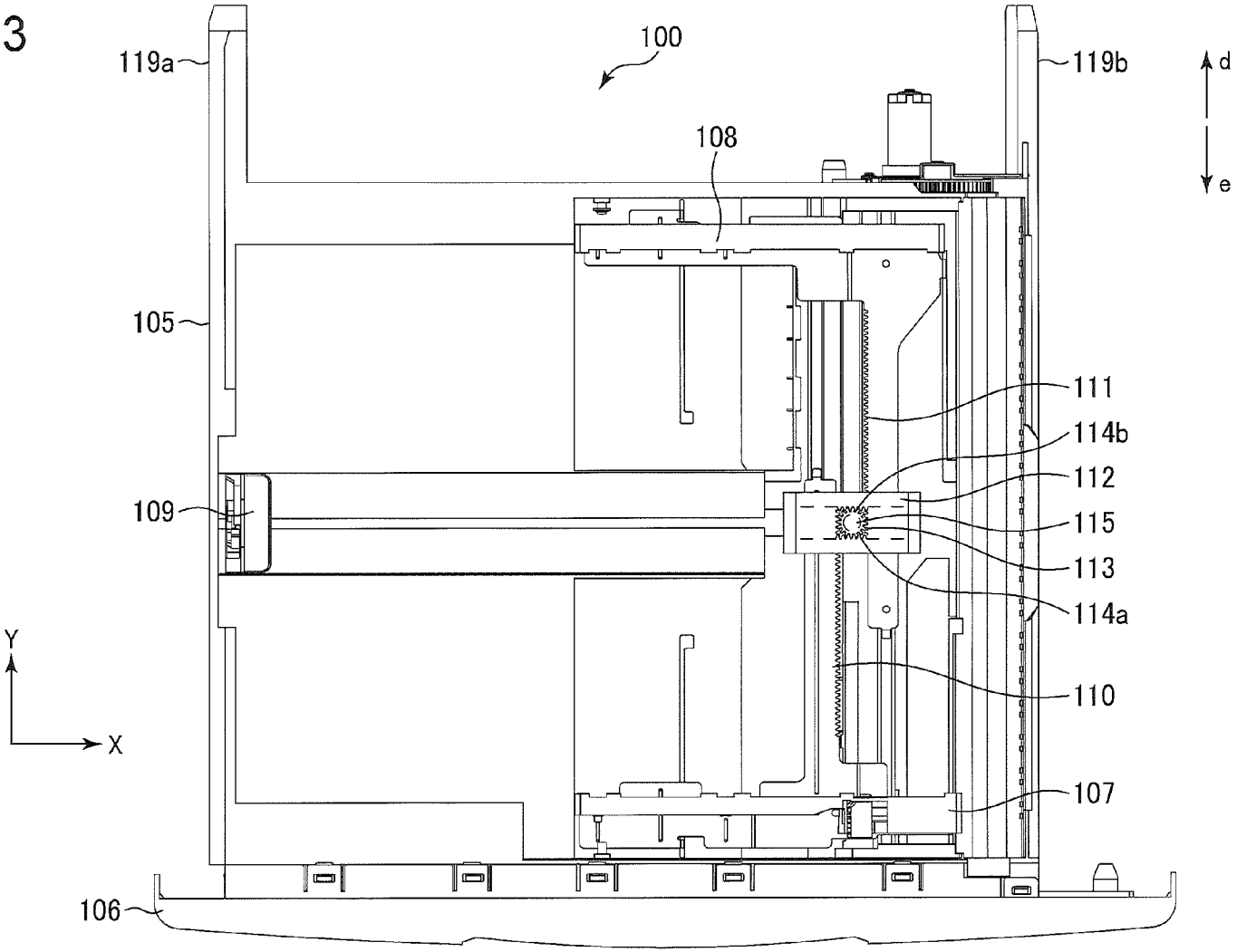
FIG. 3 is a plan view showing the medium cassette according to the first embodiment.

Next, a configuration of the medium cassette 100 according to the first embodiment will be described in detail. FIG. 2 is a perspective view showing the medium cassette 100 removed from the main body 31 of the medium feeding apparatus 30 according to the first embodiment. FIG. 3 is a plan view showing the medium cassette 100. In this regard, the placing plate 102 (FIG. 1) is omitted in FIG. 3.

In FIGS. 2 and 3, a direction in which the medium cassette 100 is inserted into the main body 31 of the medium feeding apparatus 30 is expressed as an insertion direction (shown by an arrow "d"). A direction in which the medium cassette 100 is removed from the main body 31 of the medium feeding apparatus 30 is expressed as a removal direction (shown by an arrow "e"). Hereinafter, an X-direction, a Y-direction and a Z-direction are defined based on the insertion direction (shown by the arrow "d") and the removal direction (shown by the arrow "e").

To be more specific, a horizontal plane is defined as an XY-plane. In the XY-plane, a direction parallel to an insertion/removal direction is defined as the Y-direction, and a direction perpendicular to the Y-direction is defined as the X-direction. A direction perpendicular to both of the X-direction and the Y-direction is defined as a Z-direction. A feeding direction of the medium 101 (from the medium cassette 100) is substantially parallel to the X-direction.

A cassette cover 106 is provided at an end portion of the medium cassette 100 in the removal direction (shown by the arrow "e"). The cassette cover 105 has a handle portion 116 which is gripped by a user when the medium cassette 100 is inserted into or removed from (i.e., mounted to or detached from) the main body 31 of the medium feeding apparatus 30.

The medium cassette 100 includes a medium tray 105 for storing a stack of the media 101 therein. The medium tray 105 includes a pair of medium guides 107 and 108 (i.e., a medium positioning unit) for determining positions of both ends of the stacked media 101 in a widthwise direction (i.e., both ends in the Y-direction). The medium tray 105 further includes the above described placing plate 102 (FIG. 1) on which the media 101 are placed.

The medium guides 107 and 108 are made of plate members parallel to an XZ-plane. The medium guides 107 and 108 face each other in the Y-direction. Guide racks 110 and 111 (i.e., rack portions) extend respectively from lower ends of the medium guides 107 and 108. The guide rack 110 and 111 extend inwardly (i.e., toward each other) in the Y-direction. The guide racks 110 and 111 also face each other in the X-direction. A pinion gear 113 is provided between the guide racks 110 and 111 in the X-direction. The pinion gear 113 engages both guide racks 110 and 111. The pinion gear 113 is provided for coupling (i.e., interlocking) movements of the medium guides 107 and 108 so that the medium guides 107 and 108 move symmetrically with respect to a center in the Y-direction. Further, a first engaging portion 112 (i.e., a locking unit) is provided so as to cover the guide racks 110, 111 and the pinion gear 113.

Guide rails 119*a* and 119*b* are provided on both ends of the medium cassette 100 in the X-direction. The guide rails 119*a* and 119*b* extend in the Y-direction and protruding in the insertion direction (shown by the arrow "d"). The guide rails 119*a* and 119*b* engage predetermined parts of the main body 31 of the medium feeding apparatus 30, so as to guide insertion of the medium cassette 110.

Figure 4A:
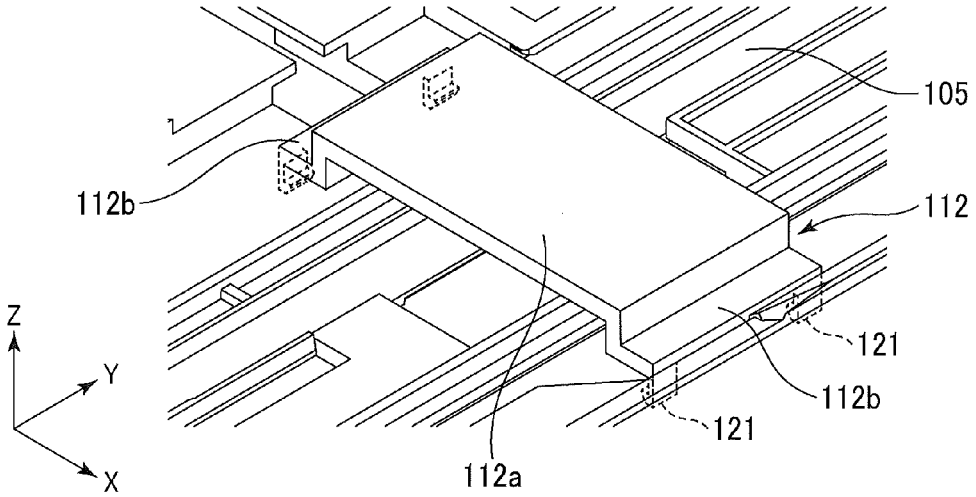
FIGS. 4A and 4B are respectively a top perspective view and a bottom perspective view showing a first engaging portion according to the first embodiment.
Figure 4B:
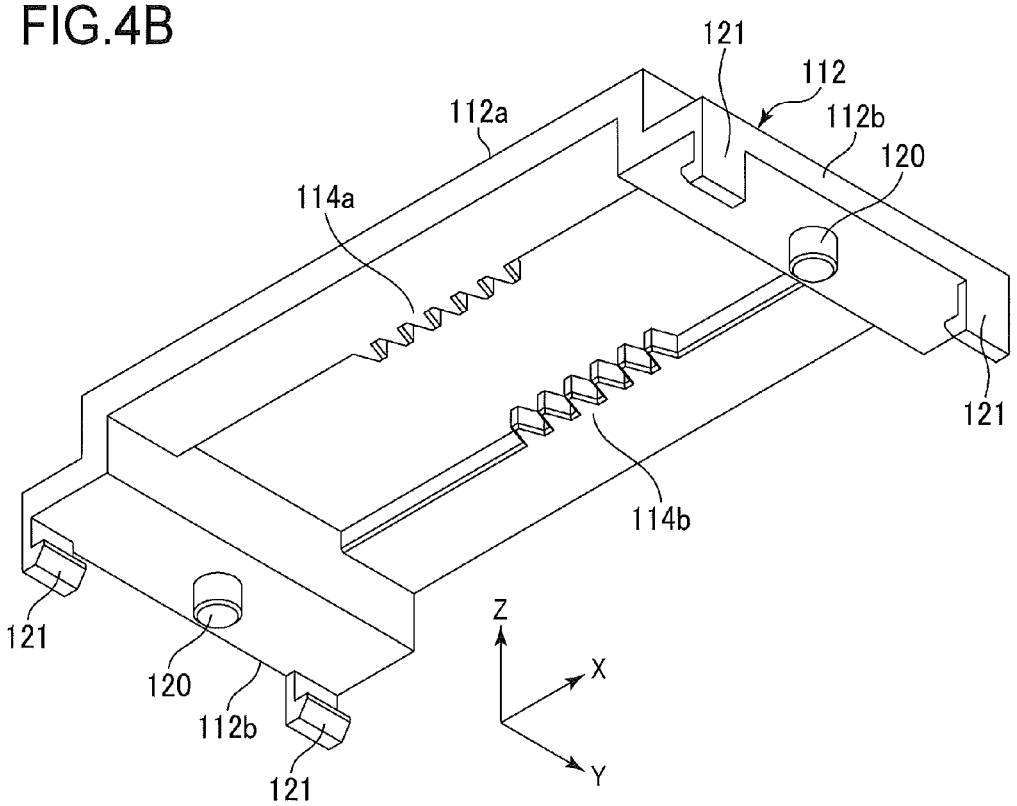

FIG. 4A is a top perspective view showing the first engaging portion 112. FIG. 4B is a bottom perspective view showing the first engaging portion 112. The first engaging portion 112 includes a main part 112*a* and a pair of base parts 112*b*. The main part 112*a* extends so as to bridge the guide racks 110 and 111 and the pinion 113 (FIG. 3). The base parts 112*b* are formed on both ends of the main part 112*a*.

As shown in FIG. 4B, engaging racks 114*a* and 114*b* (i.e., rack portions) are provided on a lower surface of the main part 112*a* of the first engaging portion 112. The lower surface of the main part 112*a* faces an upper surface of the pinion gear 113. The engaging racks 114*a* and 114*b* respectively have rack teeth facing each other. The rack teeth of the engaging racks 114*a* and 114*b* are capable of engaging teeth (i.e., a gear portion 113G described later) formed on an outer circumference of the pinion gear 113.

The first engaging portion 112 further includes posts 120 that protrude from lower surfaces of the base part 112*b*. The posts 120 engage positioning holes formed on the medium tray 105 to thereby determine a position of the first engaging portion 112. Claw portions 121 are formed on both ends of each base part 112*b* in the Y-direction. The claw portions 121 engage engaging holes formed on the medium tray 105. By engagement between the claw portions 121 and the engaging holes, the first engaging portion 112 is fixed to the medium tray 105.

Figure 5A:
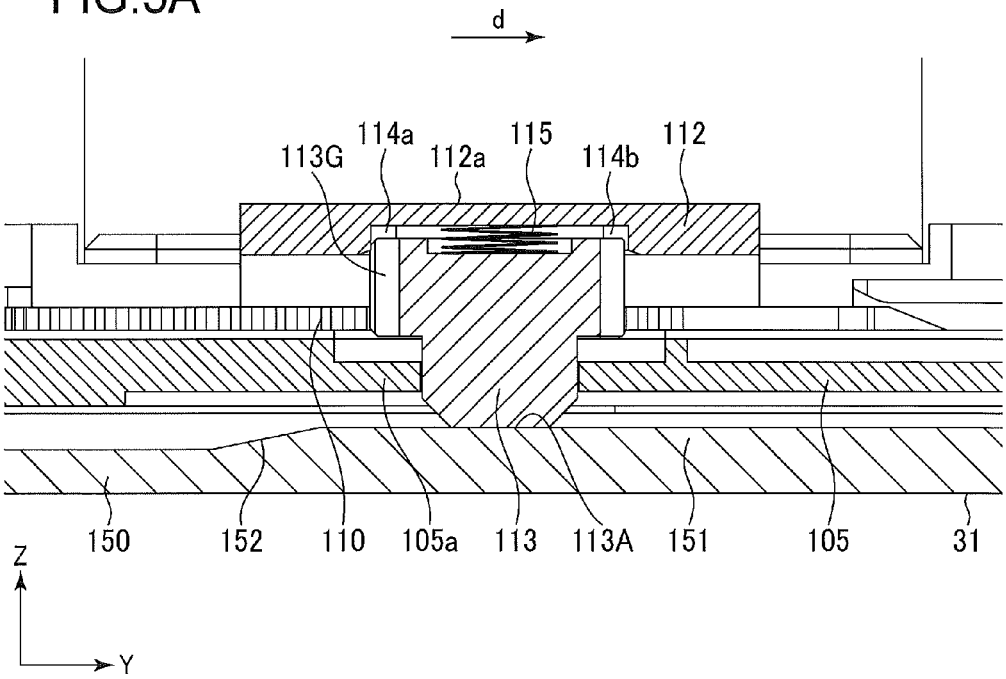
FIG. 5A is a sectional view showing a state where the medium cassette is inserted into a main body of the medium feeding apparatus according to the first embodiment.
Figure 5B:
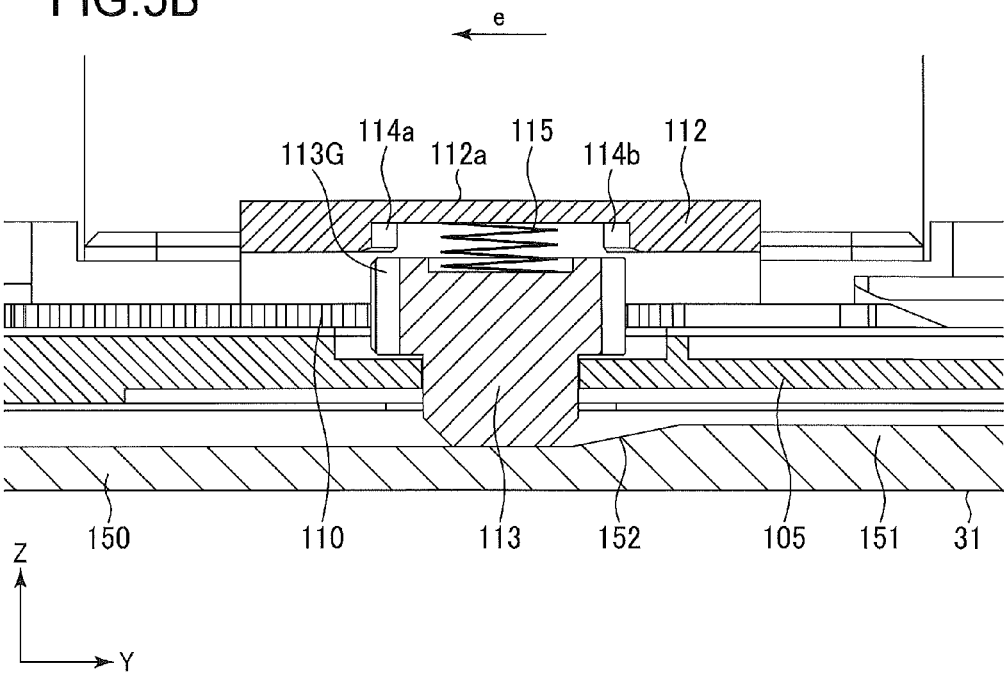
FIG. 5B is a sectional view showing state where the medium cassette is removed from the main body of the medium feeding apparatus according to the first embodiment.

FIG. 5A is a sectional view showing a state where the medium cassette 100 is being inserted into the main body 31 of the medium feeding apparatus 30. FIG. 5B is a sectional view showing a state where the medium cassette 100 is being removed from the main body 31 of the medium feeding apparatus 30.

The above described pinion gear 113 has a rotation axis extending in the Z-direction. The pinion gear 113 is movable in the Z-direction (i.e., a direction of the rotation axis). In other words, the pinion gear 113 is movable vertically. A gear portion 113G as a second engaging portion is formed on an upper part (i.e., one side in the direction of the rotation axis) of the pinion gear 113. A contact portion 113A is formed on a lower part (i.e., an opposite side in the direction of the rotation axis) of the pinion gear 113. The contact portion 113A protrudes downward via a hole formed on a bottom plate portion (i.e., a tray bottom portion) 105*a* of the medium tray 105.

Further, a biasing member 115 (for example, a coil spring) is provided on the first engaging portion 112. The biasing member 115 biases the pinion gear 113 downward along the direction of the rotation axis. A lower surface of the contact portion 113A of the pinion gear 113 faces a bottom plate portion (i.e., a main body bottom portion) 150 of the main body 31 of the medium feeding apparatus 30.

A rib 151 is formed on an upper surface of the main body bottom portion 150 of the medium feeding apparatus 30. The rib 151 has a predetermined height with respect to the upper surface of the main body bottom portion 150. The rib 151 is elongated in the Y-direction. The rib 151 includes a slope portion 152 as a contacting section. As shown in FIG. 5A, when the inserted medium cassette 100 reaches a predetermined position in the main body 31 of the medium feeding apparatus 30, the contact portion 113A of the pinion gear 113 moves along the slope portion 152 and reaches onto the rib 151 of the main body bottom portion 150 of the main body 31.

The rib 151 has the predetermined height and extends in the Y-direction, and is kept in contact with the contact portion 113A even when the medium cassette 100 is fully inserted into the main body 31 of the medium feeding apparatus 30. In this example, the rib 151 is formed on the main body bottom portion 150 so as to extend in the Y-direction. However, it is also possible to partially increase a thickness of the main body bottom portion 150.

When the contact portion 113A of the pinion gear 113 contacts the rib 151 of the main body bottom portion 150, the pinion gear 113 is pushed upward resisting the biasing force of the biasing member 115 along the Z-direction (i.e., the direction of the rotation axis).

When the pinion gear 113 moves upward, the gear portion 113G of the pinion gear 113 engages the engaging racks 114*a* and 114*b* of the first engaging portion 112. Therefore, a rotation of the pinion gear 113 is locked by the first engaging portion 112 (i.e., the engaging racks 114*a* and 114*b*).

Further, the gear portion 113G consistently engages the above described guide racks 110 and 111 (FIG. 3). Therefore, when the rotation of the pinion gear 113 is locked, movements of the guide racks 110 and 111 in the Y-direction are also locked. In this regard, the pinion gear 113 is configured not to disengage from the guide racks 110 and 111 throughout a range of movement of the pinion gear 113 in the Z-direction.

As shown in FIG. 5B, when the medium cassette 100 is removed (i.e., detached) from the main body 31 of the medium feeding apparatus 30, the contact portion 113A of the pinion gear 113 moves along the slope portion 152 from the rib 151 to reach a lower part of the main body bottom portion 150.

Therefore, the pinion gear 113 moves downward along the Z-direction by the force of the biasing member 115, and the gear portion 113G of the pinion gear 113 disengages from the engaging racks 114*a* and 114*b* of the first engaging portion 112. In this state, the pinion 113 becomes rotatable, and the guide racks 110 and 111 become movable in the Y-direction.

Here, a lock lever 117 of the medium guide 107 will be described. The lock lever 117 is provided for locking the medium guides 107 and 108 at arbitrary positions in accordance with the width of the medium 101 stored in the medium tray 105.

Figure 6:
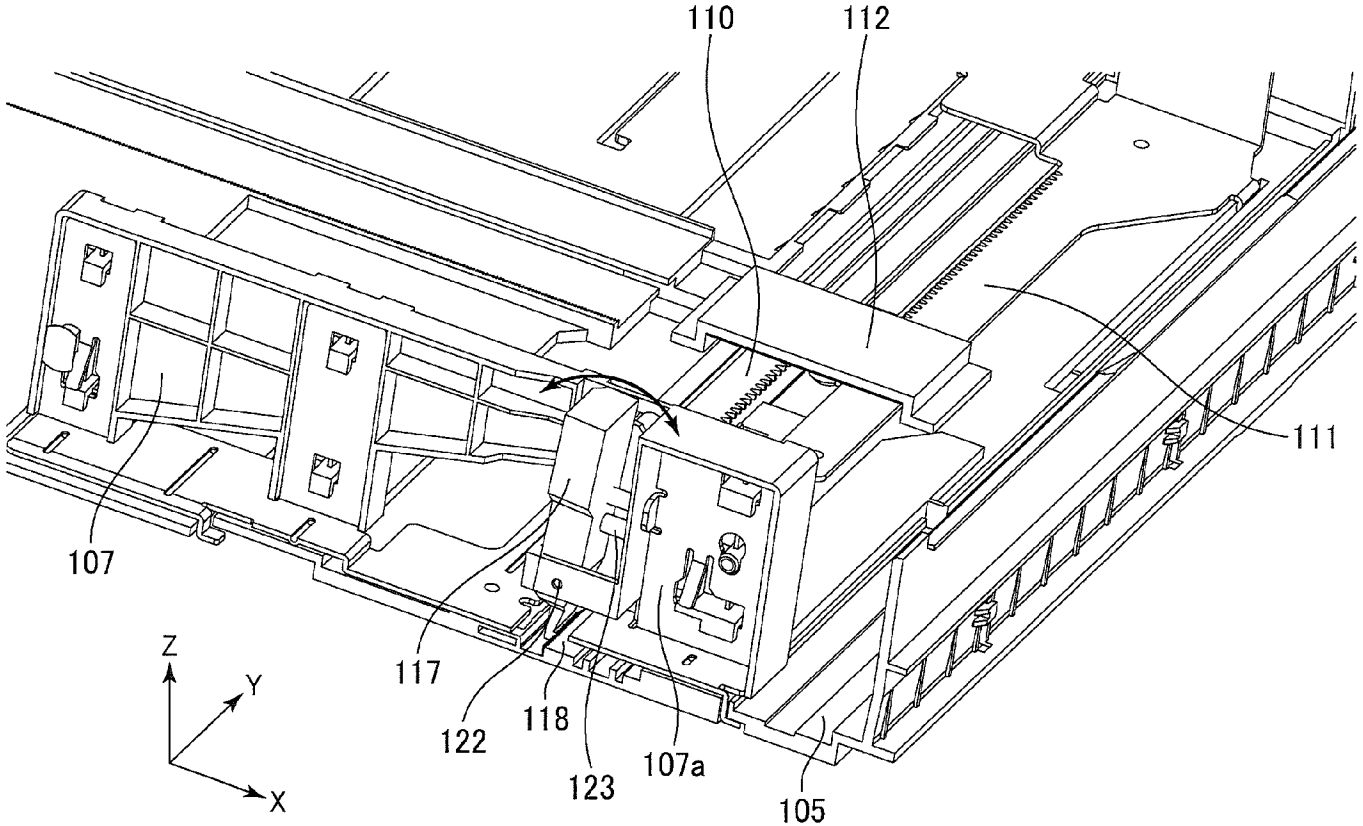
FIG. 6 is a perspective view showing a lock lever of a medium guide and surrounding components according to the first embodiment.
Figure 7A:
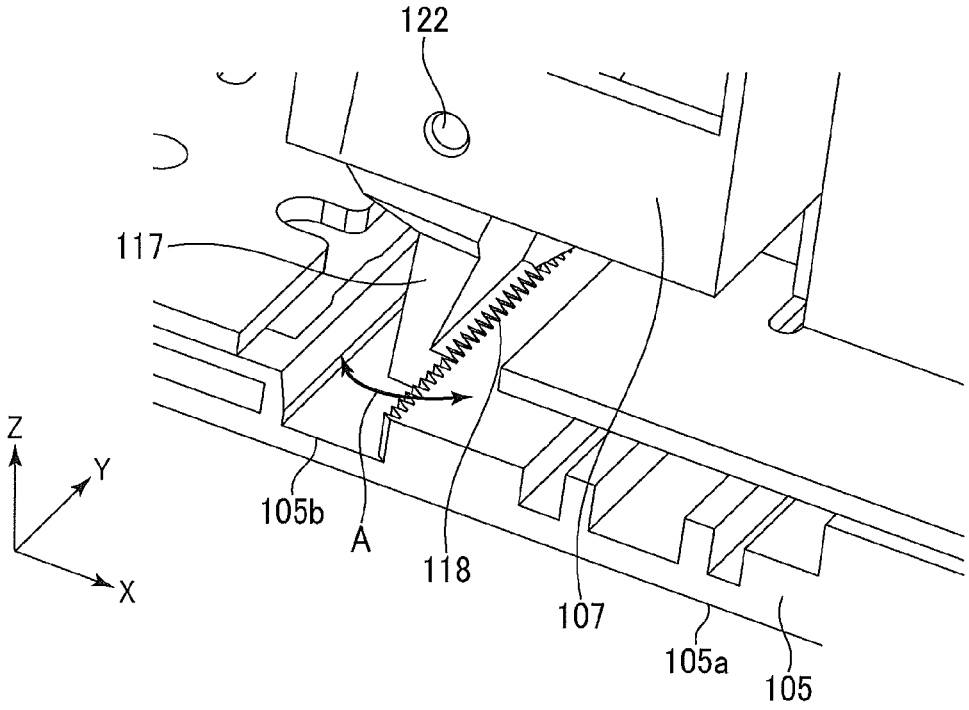
FIGS. 7A and 7B are perspective views showing an operation of the lock lever of the medium guide according to the first embodiment.
Figure 7B:
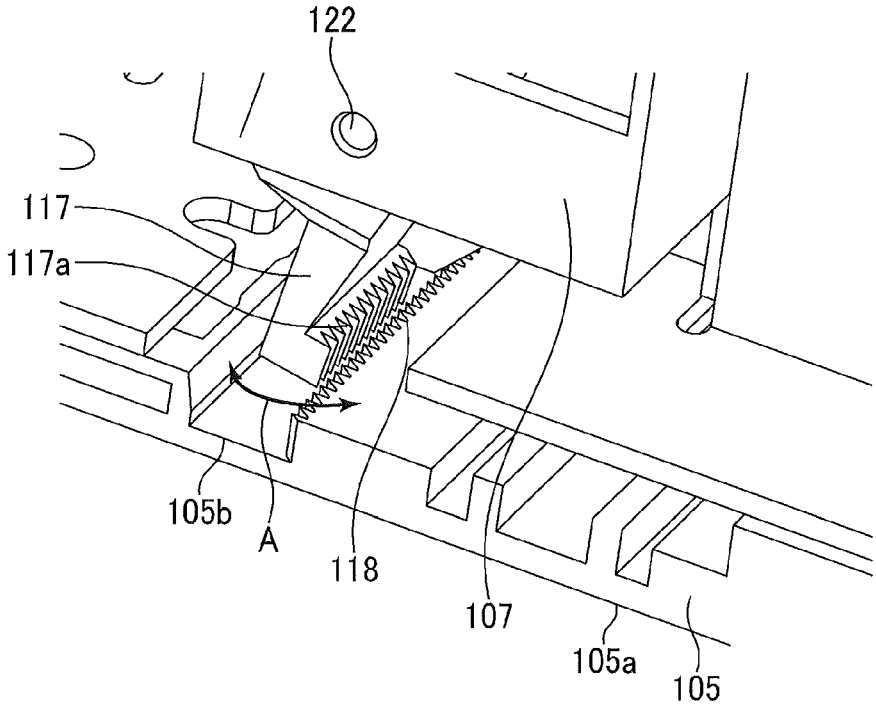

FIG. 6 is a perspective view showing the lock lever 117 of the medium guide 107 and components surrounding the lock lever 117. FIGS. 7A and 7B are perspective views for illustrating a locking function of the lock lever 117 of the medium guide 107. The lock lever 117 is supported by a supporting portion 107*a* provided on the medium guide 107 so that the lock lever 117 is swingable about a swinging axis 122 extending in the Y-direction. The lock lever 117 is rotatable as shown by arrows A in FIGS. 7A and 7B.

As shown in FIG. 7B, a rack portion 117*a* is formed on a lower end of the lock lever 117. The rack portion 117*a* has a plurality of teeth arranged in the Y-direction. The medium tray 105 has a groove 105*b* extending along a path of a movement of the lower end of the lock lever 117 (including the rack portion 117*a*) in the Y-direction following the movement of the medium guide 107.

A rack portion 118 is formed on an inner surface of the groove 105*b* of the medium tray 105. The rack portion 118 of the groove 105*b* engages the rack portion 117*a* of the lock lever 117. A biasing member 123 (FIG. 6) such as a coil spring is provided between the lock lever 117 and the supporting portion 107*a*. The biasing member 123 biases the lock lever 117 in a direction in which the rack portion 117*a* of the lock lever 117 engages the rack portion 118.

In a state shown in FIGS. 6 and 7A, the rack portion 117*a* of the lock lever 117 engages the rack portion 118 of the medium tray 105. Therefore, the lock lever 117 locks the medium guide 107 at a predetermined position in the Y-direction. In other words, the movement of the medium guide 107 is locked. Further, the movement of the medium guide 108 is coupled with the movement of the medium guide 107, since the guide racks 110 and 111 both engages the pinion gear 113. Therefore, when the movement of the medium guide 107 is locked, the movement of the medium guide 108 is also locked.

Further, when a user pushes an upper end of the lock lever 117 in a direction resisting the biasing force of the biasing member 123, the rack portion 117*a* of the lock lever 117 moves apart from the rack portion 118 of the medium tray 105. Therefore, the medium guide 107 becomes movable in the Y-direction. The medium guide 108 becomes movable symmetrically to the medium guide 107.

Next, a control system of the printer 10 will be described.

FIG. 8 is a block diagram showing a control system of the printer 10 including the medium feeding apparatus 30 according to the first embodiment. A control unit 600 of the printer 10 includes a main controller 601. The main controller 601 includes a CPU (Central Processing Unit) having a control section, an arithmetic section and the like. The main controller 601 further includes a RAM (Random Access Memory) and a ROM (Read Only Memory) as a program memory, a timer counter, and the like.

Detection signals are inputted into the main controller 601 via an input port. The detection signals are outputted by the passage sensors 302 and 313, the writing sensor 314 and the ejection sensor 506. Based on the received detection signals, the main controller 601 performs control (i.e., activation, stopping, or switching between operations) of components of the printer 10.

The main controller 601 is also connected to a feed motor controller 602, a clutch controller 603, a belt motor controller 604, an ID motor controller 605 and a fixing motor controller 606.

The feed motor controller 602 sends an actuation signal to the feed motor 711 to thereby control the rotation of the feed motor 711. The clutch controller 603 send an actuation signal to the electromagnetic clutch 706 to thereby control the operation of the electromagnetic clutch 706. With this process, rotations of the pickup roller 202, the feed roller 203, the conveying rollers 303 and 310 and the ejection rollers 504*a*, 504*b* and 504*c* are controlled. That is, the feeding and conveying of the medium 101 are controlled.

The belt motor controller 604 sends an actuation signal to the belt motor 609 to thereby control the rotation of the belt motor 609. With this process, the conveying of the medium 101 by the transfer belt 461 is controlled.

The ID motor controller 605 sends an actuation signal to the ID motor 610 to thereby control the rotation of the ID motor 610. With this process, rotations of the photosensitive drum 431 and the developing roller 434 of each of the process units 430K, 430Y, 430M and 430C are controlled. In this regard, the charging roller 432 rotates following the rotation of the photosensitive drum 431.

The fixing motor controller 606 sends an actuation signal to the fixing motor 611 to thereby control the rotation of the fixing motor 611. With this process, rotations of the upper roller 501 and the lower roller 502 of the fixing unit 500 are controlled.

These motors are, for example, two-phase excitation pulse motors, DC (Direct Current) motors or the like. The two-phase excitation pulse motor is driven by a constant current. Acceleration and deceleration of the rotation speed of the motor are controlled by switching a phase current direction based on rising of clock signal, or by varying a clock frequency. A rotation speed of the DC motor is controlled by controlling a voltage applied to motor terminals. A rotating direction of the DC motor is controlled by changing polarities of the motor terminals.

The main controller 601 is connected to an operation panel 612. The operation panel 612 includes an input unit 612*a* and a display unit 612*b*. The input unit 612*a* has switches and the like. The display unit 612*b* has an LED (Light Emitting Diode), LCD (Liquid Crystal Display) and the like. Setting of conditions (for example, choice of font or choice of medium) of the printer 10 can be performed using the input unit 612*a* of the operation panel 612. The display unit 612*b* displays the conditions set by means of the input unit 612*a*.

The main controller 601 is connected to an interface unit 613. The interface unit 613 includes an interface connector, an interface IC (Integrated Circuit) and the like. The interface unit 613 receives a print data (i.e., image data) sent from a host computer HC, and transfers the received data to the main controller 601.

The control unit 600 of the printer 10 is capable of sending a signal to the medium feeding apparatus 30 via a connector connecting the main body of the printer 10 and the medium feeding apparatus 30. The signal is for controlling an operation of the medium feeding apparatus 30 (for example, rotations of the hopping roller 202 and the feed roller 203).

The control unit 600 of the printer 10 further includes voltage controllers for controlling charging voltages, developing voltages and transfer voltages applied to the charging rollers 432, the developing rollers 434 and the transfer rollers 464, temperature controllers for controlling temperatures of the heat sources 503*a* and 503*b* of the fixing unit 500, and a lift-up controller for driving the motor 104 (FIG. 1) to swing the lift-up lever 103. The voltage controllers, the temperature controllers and the lift-up controller are omitted in FIG. 8.

Next, an operation of the printer 10 and an operation of the medium feeding apparatus 30 will be described. In the case of feeding the medium 101 from the medium cassette 100, the media 101 stored in the medium cassette 100 are fed into the medium feeding path one by one (beginning at the top of a stack of the media 101) by the pickup-and-feeding unit 200 including the pickup roller 202, the feed roller 203 and the retard roller 204.

The medium 101 fed by the pickup-and-feeding unit 200 passes the passage sensor 302, and reaches the conveying rollers 303. The conveying rollers 303 start rotation at a predetermined timing after the passage sensor 302 detects the passage of the medium 101. That is, the conveying rollers 303 halt for a certain time period in a state where a leading edge of the medium 101 contacts a nip portion of the conveying rollers 303. Therefore, the skew of the medium 101 is corrected. As the conveying rollers 303 start rotation, the conveying rollers 303 convey the medium 101.

The medium 101 conveyed by the conveying rollers 303 passes the passage sensor 313 and reaches the conveying rollers 310. The conveying rollers 310 start rotation when the passage sensor 302 detects the passage of the medium 101, and conveys the medium 101 toward the image forming portion 410 without stopping the medium 101. The medium 101 conveyed by the conveying rollers 310 passes the writing sensor 314 and reaches the image forming portion 410.

In the image forming portion 410, the medium 101 is conveyed by the transfer belt 461 and reaches a nip portion between the photosensitive drum 431 of the process unit 430K and the transfer roller 464. In the process unit 430K, the surface of the photosensitive drum 431 is uniformly charged by the charging roller 432. The uniformly charged surface of the photosensitive drum 431 is exposed with light emitted by the exposure device 433, and a latent image is formed on the surface of the photosensitive drum 431. The latent image on the surface of the photosensitive drum 431 is developed by the developing roller 434 using a black toner (i.e., a developer), and a toner image (i.e., a develop image) is formed on the surface of the photosensitive drum 431. When the medium 101 passes the nip portion between the photosensitive drum 431 and the transfer roller 464, the toner image is transferred from the surface of the photosensitive drum 431 to the medium 101.

The medium 101 further passes the process units 430Y, 430M and 430C, and the toner images of respective colors are transferred to the surface of the medium 101 in an overlapping manner.

The medium 101 having passed the process units 430K, 430Y, 430M and 430C is further conveyed by the transfer belt 461, and reaches the fixing unit 500. In the fixing unit 500, the upper roller 501 and the lower roller 502 apply heat and pressure to the medium 101, so that the toner image is fixed to the medium 101.

The medium 101 to which the toner image (i.e., a color image) is fixed by the fixing unit 500 is ejected by the ejection rollers 504*a*, 504*b* and 504*c*, and is placed on the stacker portion 505 on the upper cover of the printer 10. As a result, a formation process of the color image is completed.

In the case of feeding the medium P from the MPT 320, the media P are fed one by one from the stack on the placing plate 321 into a medium feeding path by the MPT pickup-and-feeding unit 322 including the pickup roller 323, the MPT roller 324 and the retard roller 325. The medium P passes the passage sensor 313 and reaches the conveying rollers 310.

The conveying rollers 310 start rotation after the passage sensor 313 detects the passage of the medium P. That is, the conveying rollers 310 halt for a certain time period in a state where a leading edge of the medium P contacts the nip portion of the conveying rollers 310. Therefore, a skew of the medium P is corrected. As the conveying rollers 310 start rotation, the conveying rollers 310 convey the medium P.

The medium P conveyed by the conveying rollers 310 passes the writing sensor 314, and reaches the image forming portion 410. Thereafter, a toner image is formed on the medium P in a similar manner as described above.

Next, the insertion and removal (i.e., the mounting and detaching) of the medium cassette 100 into and from the medium feeding apparatus 30 of the printer will be described with reference to FIGS. 5A and 5B as well as FIGS. 9A through 9F described below.

Figure 9B:
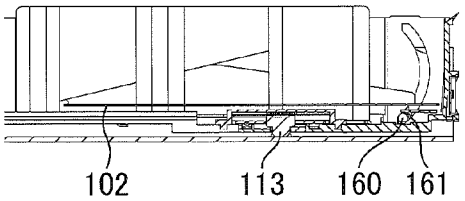
FIGS. 9A through 9F are sectional views for illustrating an insertion operation of the medium cassette into the main body of the medium feeding apparatus according to the first embodiment.
Figure 9D:
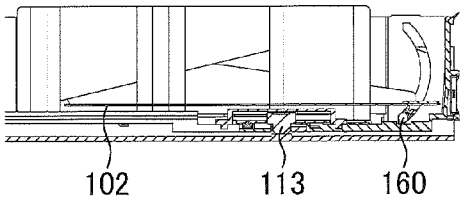
Figure 9F:
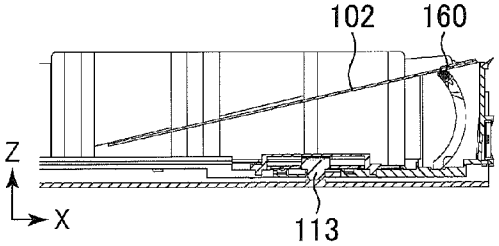
Figure 9A:
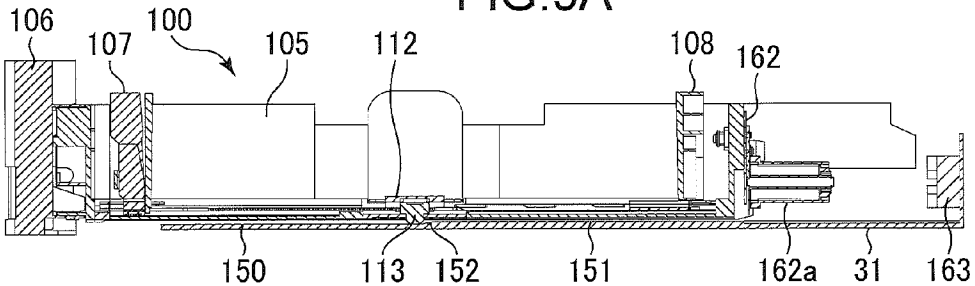
Figure 9C:
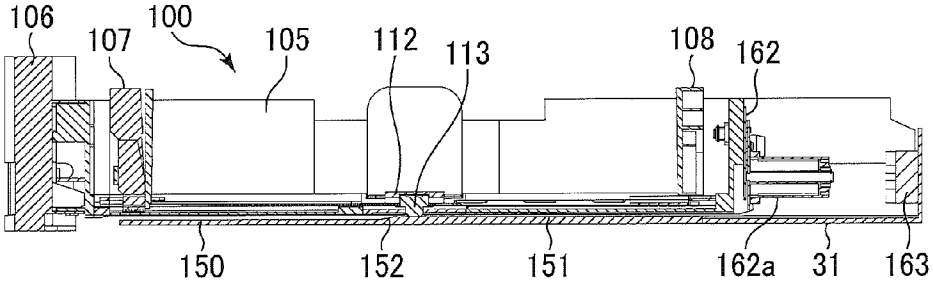
Figure 9E:
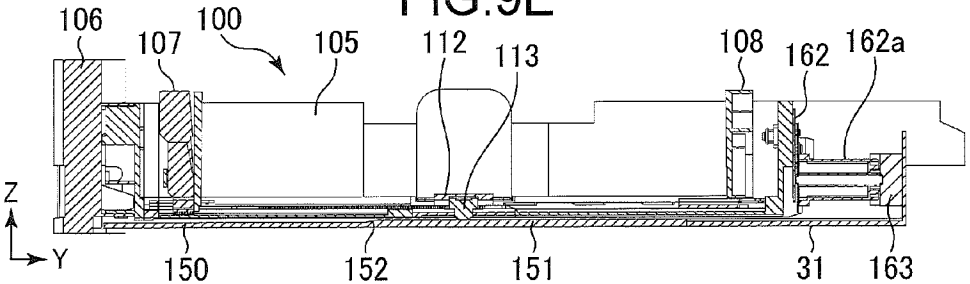

FIGS. 9A and 9B are sectional views respectively in the YZ-plane and the XZ-plane showing a state where the medium cassette 100 is inserted halfway into the main body 31 of the medium feeding apparatus 30. FIGS. 9C and 9D are sectional views respectively in the YZ-plane and the XZ-plane showing a state where the medium cassette 100 is further inserted into the main body 31 of the medium feeding apparatus 30. FIGS. 9E and 9F are sectional views respectively in the YZ-plane and the XZ-plane showing a state where the medium cassette 100 is fully (completely) inserted into the main body 31 of the medium feeding apparatus 30.

Upon insertion of the medium cassette 100 into the main body 31 of the medium feeding apparatus 30, the user grips the handle portion 116 (FIG. 2) provided on the cassette cover 106, and pushes the medium cassette 100 in the insertion direction (shown by the arrow "d") into the main body 31 of the medium feeding apparatus 30.

As the medium cassette 100 is inserted into the main body 31 of the medium feeding apparatus 30, the lower end (i.e., the contact portion 113A shown in FIG. 5A) of the pinion gear 113 moves along the slope portion 152 and reaches onto the rib 151 (having a predetermined height) of the main body bottom portion 150. Therefore, the pinion gear 113 is pushed upward along the direction of the rotational axis (i.e., the Z-axis) resisting the biasing force of the biasing member 115 as shown in FIG. 9C.

As the pinion gear 113 is pushed upward, the gear portion 113G of the pinion gear 113 engages the engaging racks 114*a* and 114*b* of the first engaging portion 112 (FIG. 5A). Since the gear portion 113G of the pinion gear 113 also engage the guide racks 110 and 111 provided perpendicularly to the engaging racks 114*a* and 114*b*, the rotation of the pinion gear 113 is locked.

In a state where the pinion gear 113 is pushed upward by the rib 151 of the main body bottom portion 150, the medium cassette 100 is further inserted into the main body 31 of the medium feeding apparatus 30. As a result, the medium cassette 100 is fully (completely) inserted into the main body 31 of the medium feeding apparatus 30 as shown in FIG. 9E. That is, the insertion of the medium cassette 100 is completed.

During the insertion operation, the pinion gear 113 is kept being pushed upward by the rib 151 of the main body bottom portion 150. Therefore, the pinion gear 113 does not disengage from the engaging racks 114*a* and 114*b*. Therefore, the medium guides 107 and 108 do not move.

In this regard, when the medium cassette 100 is fully inserted into the main body 31, a connecting portion 162*a* of the lift-up gear 162 engages a driving gear 163 provided on the medium feeding apparatus 30 as shown in FIG. 9E. The driving gear 163 is rotated by the motor 104 (FIG. 1). The rotation of the motor 104 causes the lift-up gear 162 to rotate.

The lift-up gear 162 is a sun gear. The lift-up gear 162 engages a planetary gear 161 mounted to a lift-up shaft 160. The lift-up shaft 160 is provided on the medium cassette 100 so as to be vertically movable. The rotation of the lift-up gear 162 causes the planetary gear 161 (FIG. 9B) to revolve and rotate, so that the lift-up shaft 160 vertically moves. When the lift-up shaft 160 moves upward as shown in FIG. 9F, the lift-up shaft 160 contacts the placing plate 102 from bottom, and pushes the placing plate 102 upward so that the placing plate 102 swings upward.

In this regard, the lift-up shaft 160 is schematically shown as the lift-up lever 103 in FIG. 1.

Upon removal of the medium cassette 100 from the medium feeding apparatus 30, the user grips the handle 116 (FIG. 1), and pulls the medium cassette 100 in the removal direction (shown by the arrow "e"). As the medium cassette 100 moves in the removal direction, the contact portion 113A (FIG. 5B) of the lower end of the pinion gear 113 moves along the slope portion 152 from the rib to reach the lower part of the main body bottom portion 150. Since the pinion gear 113 is biased downward by the biasing member 115, the pinion gear 113 is pushed downward along the direction of the rotation axis (i.e., the Z-direction).

As shown in FIG. 5B, the gear portion 113G of the pinion gear 113 moves downward, and disengage from the engaging racks 114*a* and 114*b*. The gear portion 113G consistently engages the guide racks 110 and 111. Therefore, the pinion gear 113 becomes rotatable according to the movement of the guide racks 110 and 111. Accordingly, the user can operate the medium guides 107 and 108 in accordance with the width of the medium 101.

As described above, according to the first embodiment of the present invention, the rotation of the pinion gear 113 is locked (FIG. 5A) during the insertion of the medium cassette 100 into the main body 31 of the medium feeding apparatus 30. Therefore, it becomes possible to prevent displacement of the medium guides 107 and 108 resulted from an impact upon insertion of the medium cassette 100 or an inertia force of the medium 101.

Further, in a state where the medium cassette 100 is fully inserted into the medium feeding apparatus 30, the rotation of the pinion gear 113 is locked. Therefore, it becomes possible to prevent displacement of initial positions of the medium guides 107 and 108 resulted from an impact during transportation of the printer 10.

First Modification of First Embodiment.

Figure 10A:
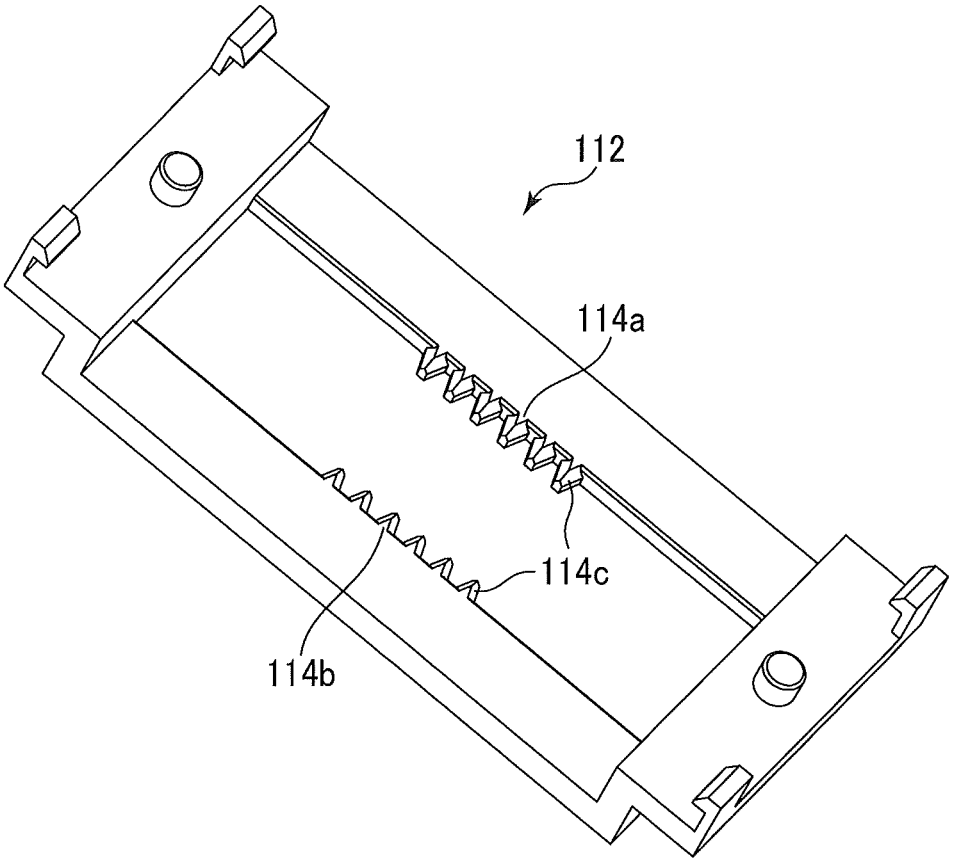
FIG. 10A is a perspective view showing a first engaging portion according to a first modification of the first embodiment.
Figure 10B:
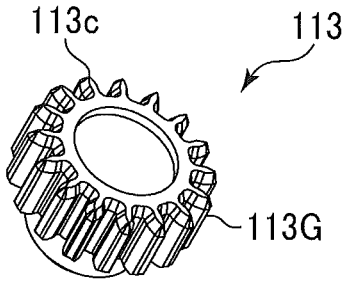
FIG. 10B is a perspective view showing a pinion gear according to the first modification of the first embodiment.

FIG. 10A is a perspective view showing a first engaging portion 112 of a first modification of the first embodiment. FIG. 10B is a perspective view showing a pinion gear 113 of the first modification of the first embodiment.

As shown in FIG. 10B, bevel portions 113*c* are formed on teeth of the gear portion 113G of the pinion gear 113. As shown in FIG. 10A, bevel portions 114*c* are formed on the rack teeth of the engaging racks 114*a* and 114*b*. The bevel portions 113*c* and 114*c* are provided for guiding the engagement between the gear portion 113G of the pinion gear 113 and the engaging racks 114*a* and 114*b* of the first engaging portion 112.

With such a configuration, even when there is a phase shift between the gear portion 113G of the pinion gear 113 and the engaging racks 114*a* and 114*b*, the gear portion 113G of the pinion gear 113 is smoothly brought into engagement with the engaging racks 114*a* and 114*b* owing to the bevel portions 113*c* and 114*c*.In this regard, since there is a certain gap between the pinion gear 113 and the engaging racks 114*a* and 114*b*, the pinion gear 113 can rotate to eliminate the phase shift.

Second Modification of First Embodiment.

Figure 11:
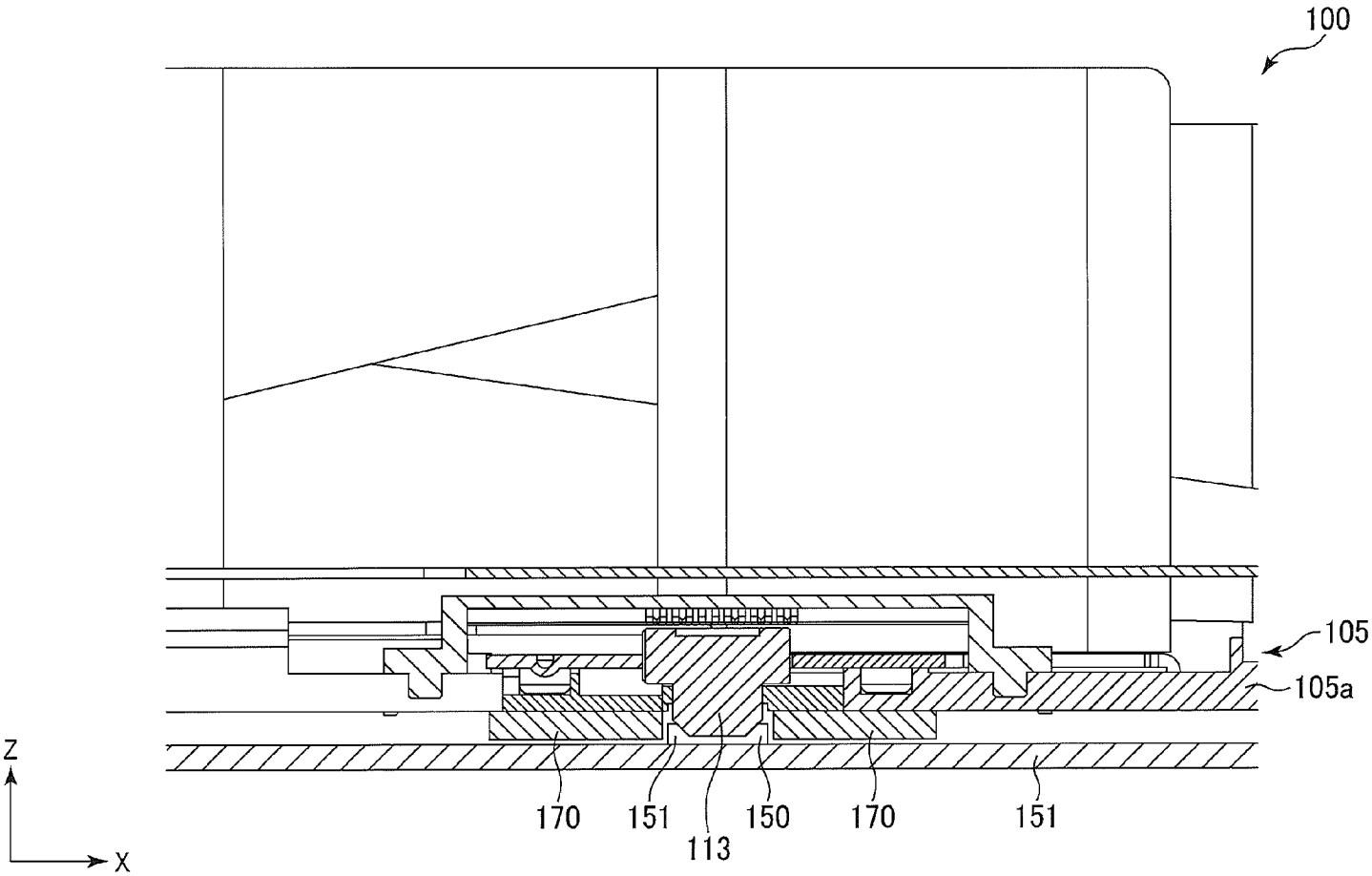
FIG. 11 is a sectional view showing a pinion gear and surrounding components according to a second modification of the first embodiment.

FIG. 11 is an enlarged sectional view showing a part of the medium cassette 100 according to the second modification of the first embodiment. In the above described first embodiment, the pinion gear 113 protrudes downward from the tray bottom portion 105*a* of the medium tray 105, and contacts the main body bottom portion 150 of the medium feeding apparatus 30. In contrast, in the medium cassette 100 of the second modification shown in FIG. 11, a pair of guides 170 protrude downward from the tray bottom portion 105*a*. The guides 170 are located on both sides of the pinion gear 113 in the X-direction.

Further, the guides 170 are disposed so as to sandwich the rib 151 (including the slope portion 152) of the medium tray 105 in the X-direction. With such a configuration, the pinion gear 113 is prevented from being pushed by other components than the rib 151 (including the slope portion 152) of the main body bottom portion 150 of the medium feeding apparatus 30. Therefore, when the medium guides 107 and 108 are operated in a state where the medium tray 105 is removed from the main body 31 of the medium feeding apparatus 30, the pinion gear 113 is not pushed by a floor or the like on which the medium tray 105 is placed.

Second Embodiment.

Figure 12:
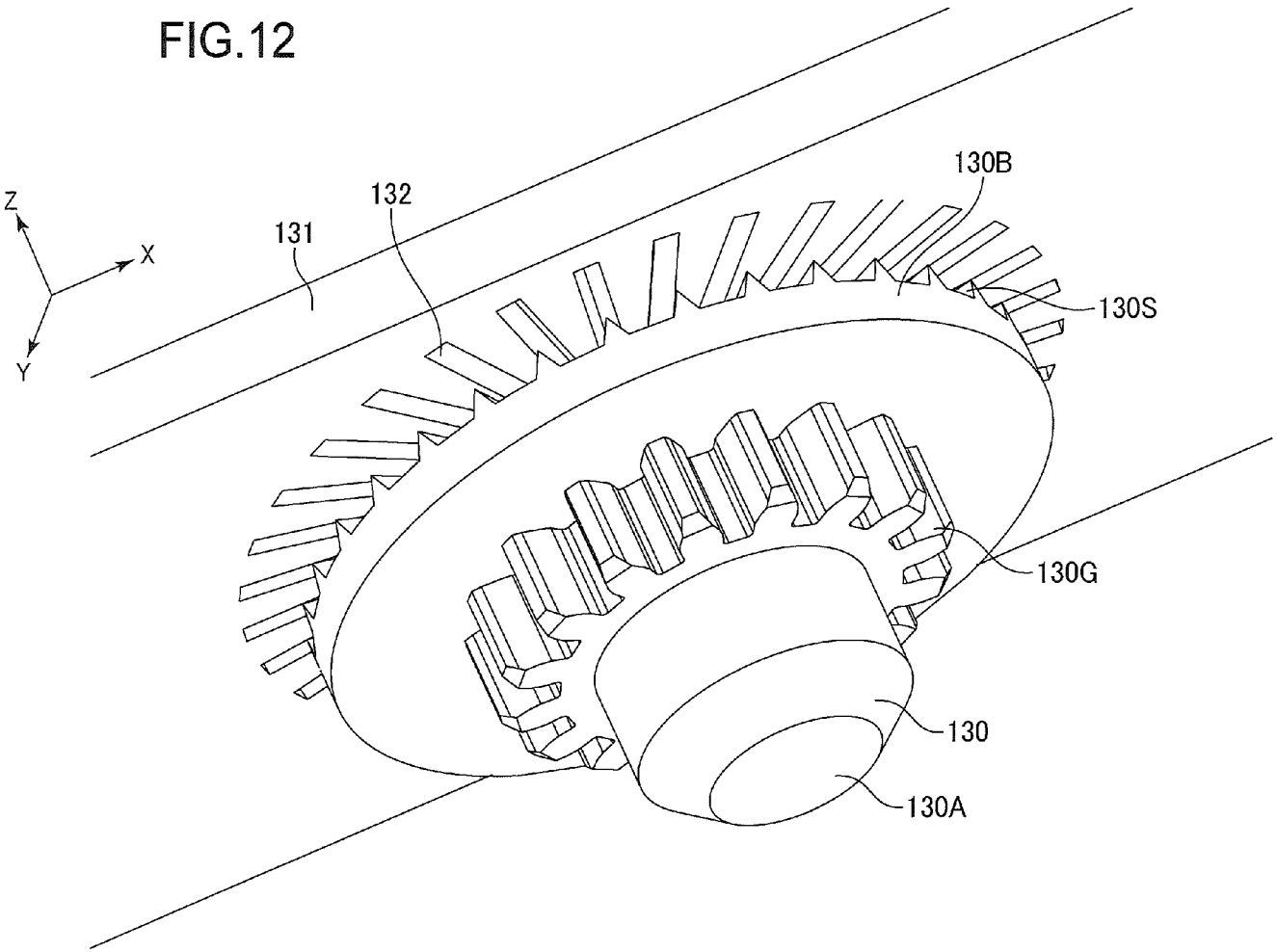
FIG. 12 is a perspective view showing a pinion gear and a first engaging portion provided on a medium cassette according to the second embodiment of the present invention.

Next, the second embodiment of the present invention will be described. FIG. 12 is a perspective view showing a pinion gear 130 and a first engaging portion 131 (i.e., a locking unit) provided on the medium cassette 100 according to the second embodiment. Components that are the same as those of the first embodiment are assigned the same reference numerals.

In the second embodiment, the pinion gear 130 shown in FIG. 12 has a second engaging portion 130B formed on an end surface (i.e., an upper end surface in the direction of the rotation axis) facing the first engaging portion 131. The second engaging portion 130B has convex portions 130S in the form of serrations (i.e., saw-teeth).

The pinion gear 130 includes a gear portion 130G that engages the guide racks 110 and 111, and a contact portion 130A that contacts the main body bottom portion 150 of the medium feeding apparatus 30. The gear portion 130G has a structure substantially the same as the gear portion 113G (FIG. 5A) of the first embodiment except that the gear portion 130G does not engage the first engaging portion 131. The contact portion 130A has a structure substantially the same as the contact portion 113A (FIG. 5A) of the first embodiment.

Concave portions 132 are formed on a lower surface of the first engaging portion 131 facing the pinion gear 130. The concave portions 132 are engageable with the convex portions 130S of the second engaging portion 130B. The concave portions 132 are formed at the same arrangement pitch as the convex portions 130S. A large number of convex portions 130S of the pinion gear 130 extend radially about a rotation axis of the pinion gear 130. A large number of concave portions 132 of the first engaging portion 131 extend radially about the rotation axis of the pinion gear 130.

Further, the convex portions 130S of the pinion gear 130 and the concave portions 132 of the first engaging portion 131 are arranged at the same arrangement pitch as the rack portion 117*a* (FIG. 7B) of the lock lever 117 and the rack portion 118 (FIG. 7B) of the tray 105.

The pinion gear 130 is movable in the direction of the rotation axis (i.e., the Z-direction) as was described in the first embodiment. Further, the gear portion 130G is configured not to disengage from the guide racks 110 and 111 throughout a range of movement of the pinion gear 130 in the Z-direction.

A configuration of the printer as an image forming apparatus according to the second embodiment is the same as that of the printer 10 of the first embodiment except configurations of the pinion gear 130 and the first engaging portion 131. An operation of the printer according to the second embodiment is the same as that of the printer 10 of the first embodiment.

Figure 13A:
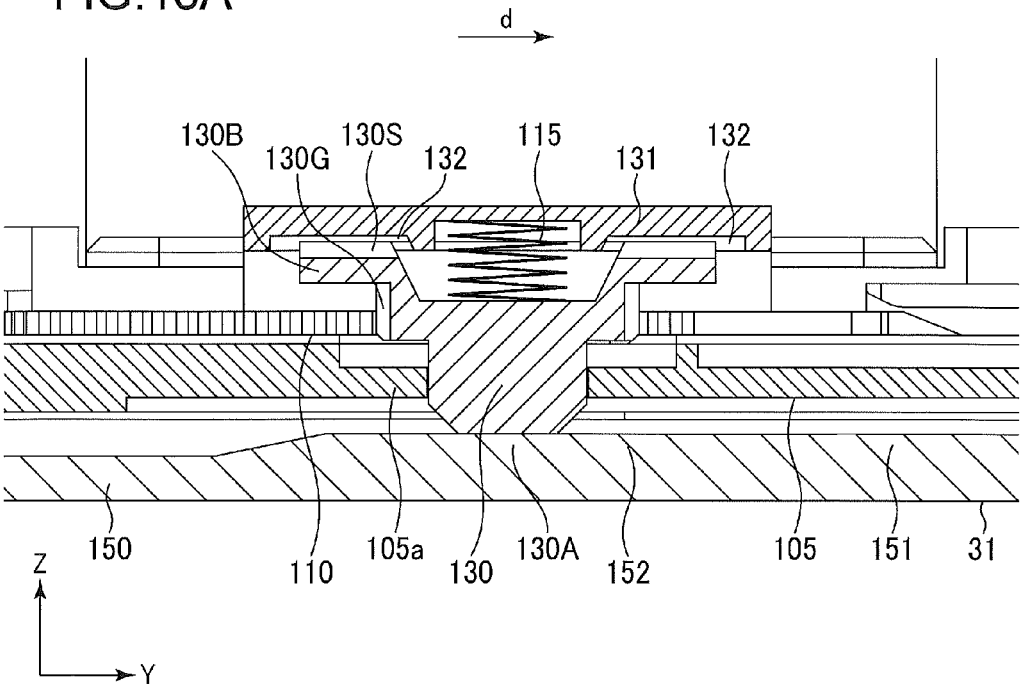
FIG. 13A is a sectional view showing an insertion operation of the medium cassette into a main body of a medium feeding apparatus according to the second embodiment of the present invention.
Figure 13B:
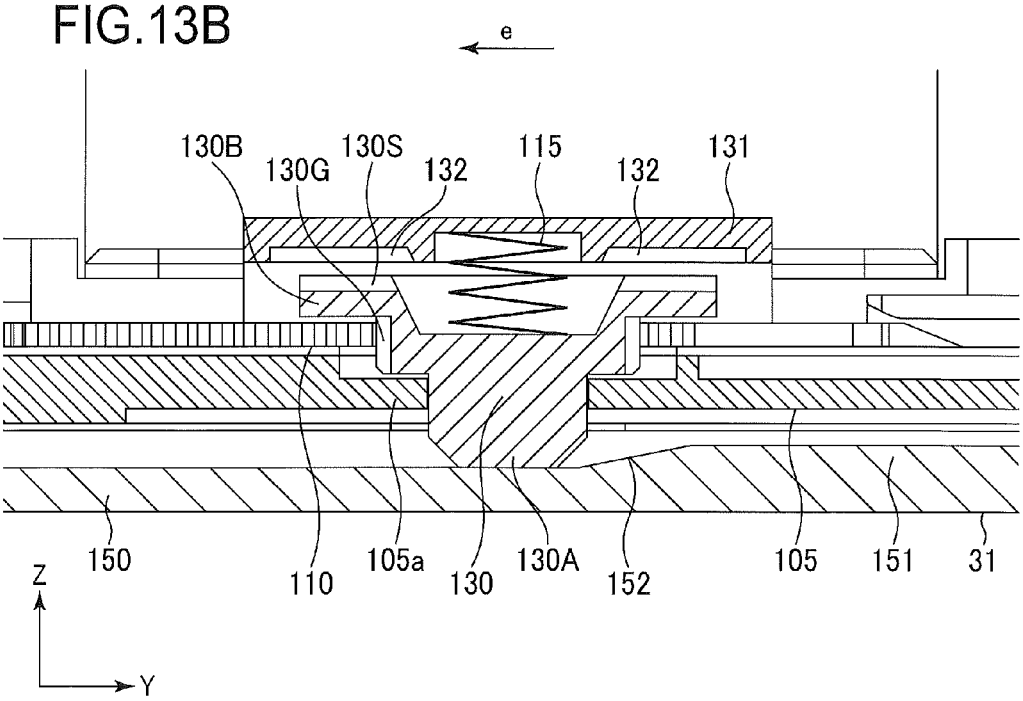
FIG. 13B is a sectional view showing a removal operation of the medium cassette from the main body of the medium feeding apparatus according to the second embodiment of the present invention.

Next, the insertion and removal of the medium cassette 100 according to the second embodiment will be described. FIG. 13A is a sectional view showing a state where the medium cassette 100 is inserted halfway into the main body 31 of the medium feeding apparatus 30. FIG. 13B is a sectional view showing a state where the medium cassette 100 is removed halfway from the main body 31 of the medium feeding apparatus 30.

Upon insertion of the medium cassette 100 into the medium feeding apparatus 30, the user grips the handle portion 116 provided on the cassette cover 106 (FIG. 2), and pushes the medium cassette 100 in the insertion direction (shown by the arrow "d") into the main body 31 of the medium feeding apparatus 30. In this state, as shown in FIG. 13A, the contact portion 130A of the pinion gear 130 moves along the slope portion 152 and reaches onto the rib 151 having the predetermined height. Therefore, the pinion gear 130 is pushed upward along the direction of the rotation axis (i.e., the Z-direction) resisting the biasing force of the biasing member 115.

As the pinion gear 130 is pushed upward, the convex portions 130S (i.e., the second engaging portion 130B) of the pinion gear 130 engages the concave portions 132 of the first engaging portion 131. The convex portions 130S and the concave portions 132 (formed at the same arrangement pitch) engage each other. Therefore, the rotation of the pinion gear 130 is locked. Then, the medium cassette 100 is further inserted into the main body 31 of the medium feeding apparatus 30. During the insertion, the pinion gear 130 is kept being pushed upward by the rib 151 of the main body bottom portion 150, and therefore the convex portions 130S do not separate from the concave portions 132.

The convex portions 130S of the pinion gear 130 and the concave portions 132 of the first engaging portion 131 are in the form of serrations, and can be formed into fine shapes. Further, the convex portions 130S of the pinion gear 130 and the concave portions 132 of the first engaging portion 131 are arranged at the same arrangement pitch as the rack portion 117*a* (FIG. 7B) of the lock lever 117 and the rack portion 118 (FIG. 7B) of the tray 105. Therefore, it becomes possible to lock the medium guides 107 and 108 by the pinion gear 130 at a fine pitch (for example, 0.5 mm or 1.0 mm) according to the width of the medium 101.

Upon removal of the medium cassette 100 from the medium feeding apparatus 30, the user grips the handle 116 (FIG. 2), and pulls the medium cassette 100 in the removal direction (shown by the arrow "e"). As shown in FIG. 13B, the contact portion 130A of the pinion gear 130 moves along the slope portion 152 from the rib 151 to reach the lower part of the main body bottom portion 150. Since the pinion gear 130 is biased downward by the biasing member 115, the pinion gear 130 is pushed downward along the direction of the rotation axis (i.e., the Z-direction).

The convex portions 130S of the pinion gear 130 move downward, and disengage from the concave portions 132 of the first engaging portion 131. The gear portion 131G consistently engages the guide racks 110 and 111. Therefore, the pinion gear 130 becomes rotatable according to the movement of the guide racks 110 and 111. Accordingly, the user can operate the medium guides 107 and 108 in accordance with the width of the medium 101.

As described above, according to the second embodiment of the present invention, the concave portions 132 of the first engaging portion 131 and the convex portions 130S (i.e., the second engaging portion 130B) of the pinion gear 130 are in the form of serrations, and therefore can be arranged at a finer pitch than the arrangement pitch of the gear portion 130G. Therefore, the positions of the medium guides 107 and 108 can be finely set in accordance with the width of the medium 101.

Further, a large number of concave portions 132 of the first engaging portion 131 engage a large number convex portions 130S (i.e., the second engaging portion 130B) of the pinion gear 130, and therefore it becomes possible to enhance a strength against an impact upon insertion of the medium cassette 100 into the medium feeding apparatus 30.

In this regard, it is also possible that the first engaging portion 131 have convex portions instead of the concave portions 132, and the second engaging portion 130B of the pinion gear 130 have concave portions instead of the convex portions 130S.

Modification of Second Embodiment.

Figure 14A:
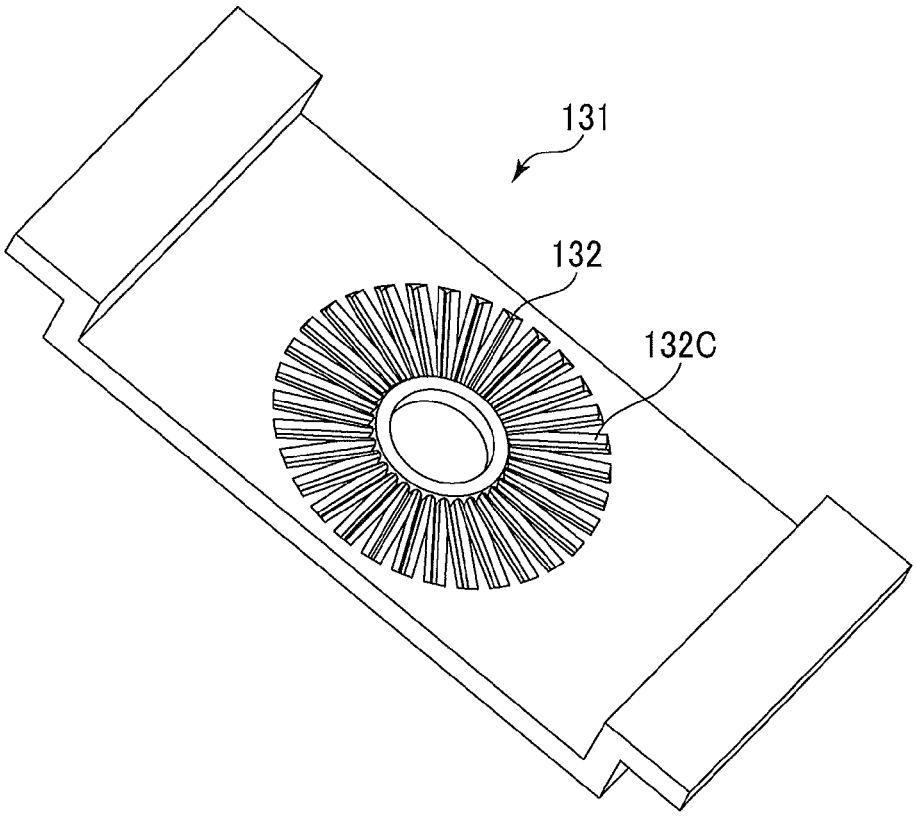
FIG. 14A is a perspective view showing a first engaging portion according to a first modification of the second embodiment.
Figure 14B:
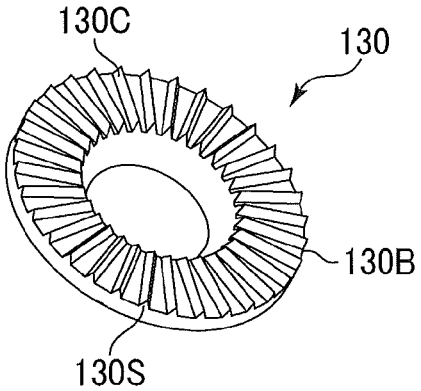
FIG. 14B is a perspective view showing a pinion gear according to the first modification of the second embodiment.

FIG. 14A is a perspective view showing a first engaging portion 131 according to a modification of the second embodiment. FIG. 14B is a perspective view showing a second engaging portion 130B of the pinion gear 130 according to the modification of the second embodiment.

As shown in FIG. 14A, bevel portions 132C are formed on concave portions 132 of the first engaging portion 131. As shown in FIG. 14B, bevel portions 130C are formed on convex portions 130S (i.e., the second engaging portion 130B) of the pinion gear 130. The bevel portions 132*c* and 130*c* are provided for guiding the engagement between the concave portions 132 and the convex portions 130S.

With such a configuration, even when there is a phase shift between the concave portions 132 of the first engaging portion 131 and the convex portions 130S of the pinion gear 130, the concave portions 132 and the convex portions 130S are smoothly brought into engagement with each other owing to the bevel portions 132C and the 130C.

In the above described first and second embodiments and their modifications, the engagement between the gear portion 113G of the pinion gear 113 and the engaging racks 114*a* and 114*b*, and the engagement between the convex portions 130S and the concave portions 132 are used. However, the present invention is not limited to such configurations. For example, it is also possible to use a detent mechanism.

Third Embodiment.

Figure 15A:
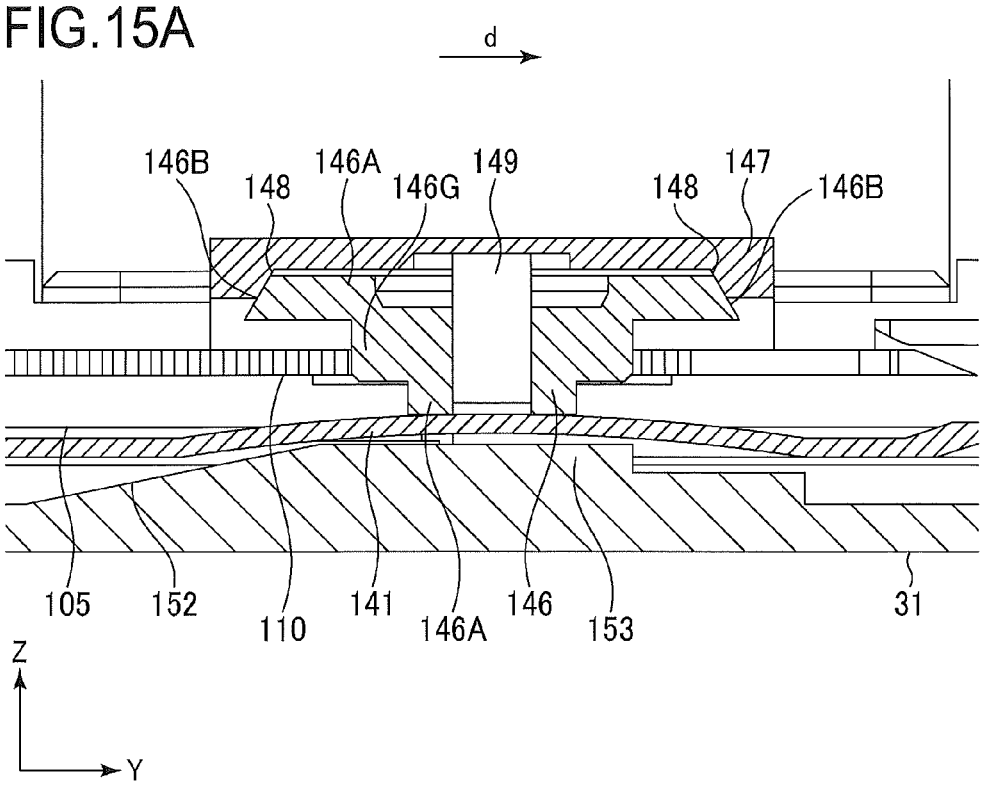
FIG. 15A is a sectional view showing an insertion operation of a medium cassette into a main body of a medium feeding apparatus according to the third embodiment of the present invention.
Figure 15B:
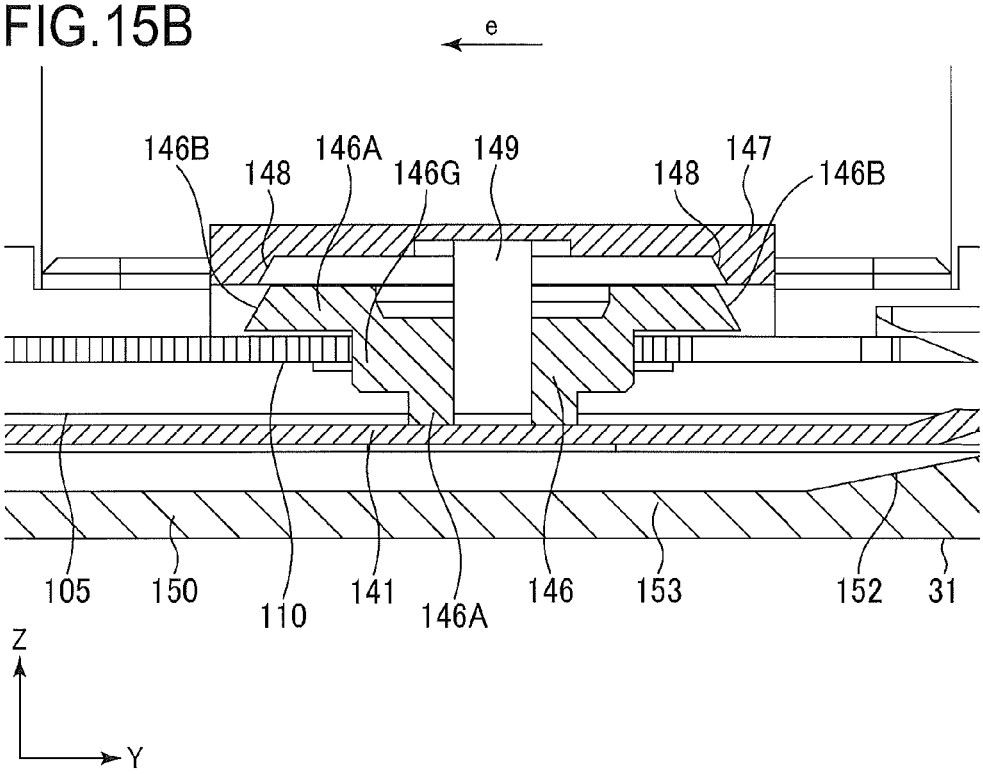
FIG. 15B is a sectional view showing a removal operation of the medium cassette from the main body of the medium feeding apparatus according to the third embodiment of the present invention.

Next, the third embodiment of the present invention will be described. FIG. 15A is a sectional view showing a state where the medium cassette 100 is inserted halfway into the main body 31 of the medium feeding apparatus 30. FIG. 15B is a sectional view showing a state where the medium cassette 100 is removed halfway from the main body 31 of the medium feeding apparatus 30. Components that are the same as those of the first or second embodiment are assigned the same reference numerals.

The above described pinion gear 130 of the second embodiment has the convex portions 130S (i.e., the second engaging portion 130B) in the form of serrations at the upper surface thereof. In contrast, a pinion gear 146 of the third embodiment has a friction engaging portion 146B on an outer circumference of an end portion (i.e., an upper end portion in the direction of the rotation axis) facing a first engaging portion 147 (i.e., a locking unit). The friction engaging portion 146B (i.e., a friction contact portion) corresponds to a second engaging portion. The friction engaging portion 146B is inclined with respect to the Z-direction at a predetermined angle.

A contact portion 148 is provided on a surface of the first engaging portion 147 facing the friction engaging portion 146B. The contact portion 148 is a slope surface capable of contacting the friction engaging portion 146.

The pinion gear 146 includes a gear portion 146G that engages the guide racks 110 and 111, and a contact portion 146A pushed by a rib 153 of the main body bottom portion 150 of the medium feeding apparatus 30.

The pinion gear 146 is supported by a supporting portion 149 provided on the first engaging portion 147 so that the pinion gear 146 is movable in the direction of the rotation axis (i.e., the Z-direction). Further, the gear portion 146G is configured not to disengage from the guide racks 110 and 111 throughout a range of movement of the pinion gear 146 in the Z-direction.

The contact portion 146A of the pinion gear 146 does not protrude downward from the medium tray 105, unlike the pinion gear 113 (130) of the first and second embodiments. Instead, a pressing portion 141 is provided on the medium tray 105. The pressing portion 141 is provided so as to contact a lower surface of the contact portion 146A of the pinion gear 146.

When the medium cassette 100 is inserted into the main body 31, the pressing portion 141 contacts the slope portion 152 and reaches the rib 153 (having a predetermined height) of the main body bottom portion 150 of the medium feeding apparatus 30. When the pressing portion 141 contacts the slope portion 152 and then contacts the rib 153, the pressing portion 141 is deformed as shown in FIG. 15A. Further, the deformed pressing portion 141 contacts the pinion gear 146, and pushes the pinion gear 146 upward. In this regard, the rib 153 is higher than the rib 151 of the first and second embodiment.

Other configurations of the third embodiment are the same as those described in the first and second embodiments.

Next, the insertion and removal of the medium cassette 100 according to the third embodiment will be described with reference to FIGS. 15A and 15B.

Upon insertion of the medium cassette 100 into the medium feeding apparatus 30, the user grips the handle portion 116 provided on the cassette cover 106 (FIG. 2), and pushes the medium cassette 100 in the insertion direction (shown by the arrow "d") into the main body 31 of the medium feeding apparatus 30. As shown in FIG. 15A, a lower surface of the pressing member 141 moves along the slope portion 152 and reaches onto the rib 153. In this state, the pressing member 141 is deformed as shown in FIG. 15A. The deformed pressing member 141 contacts the lower surface of the contact portion 146A of the pinion gear 146, and pushes the pinion gear 146 upward along the direction of the rotation axis (i.e., the Z-direction).

As the pinion gear 146 is pushed upward, the friction engaging portion 146B of the pinion gear 146 contacts the contact portion 148 of the first engaging portion 147. A rotation of the pinion gear 146 is locked by a friction force between the friction engaging portion 146B and the contact portion 148.

Then, the medium cassette 100 is fully inserted into the main body 31 of the medium feeding apparatus 30 in a state where the pinion gear 146 is pushed upward. During the insertion, the pinion gear 146 is kept being pushed upward by the rib 153 of the main body bottom portion 150, and therefore the friction engaging portion 146B and the contact portion 148 do not separate from each other.

Upon removal of the medium cassette 100 from the medium feeding apparatus 30, the user grips the handle 116 (FIG. 2), and pulls the medium cassette 100 in the removal direction (shown by the arrow "e"). As shown in FIG. 15B, the lower surface of the pressing member 141 moves along the slope portion 152 from the rib 153 to reach the lower part of the main body bottom portion 150. In this state, the pressing member 141 recovers its original shape, and does not push the pinion gear 146. Therefore, the pinion gear 130 moves downward along the direction of the rotation axis (i.e., the Z-direction).

As the pinion gear 130 moves downward, the friction engaging portion 146B of the pinion gear 146 disengage from the contact portion 148 of the first engaging portion 147. The gear portion 146G of the pinion gear 146 consistently engages the guide racks 110 and 111. Therefore, the pinion gear 146 becomes rotatable according to the movement of the guide racks 110 and 111. Accordingly, the user can operate the medium guides 107 and 108 in accordance with the width of the medium 101.

As described above, according to the third embodiment of the present invention, the following advantages can be obtained in addition to the advantages described in the first and second embodiments. That is, since the pinion gear 146 is locked by the friction between the contact portion 148 of the first engaging portion 147 and the friction engaging portion 146B of the pinion gear 146, the pinion gear 146 can be locked regardless of the position of the guide racks 107 and 108. Therefore, the third embodiment is advantageous even in the case where the teeth of the guide racks 110 and 111 of the medium guides 107 and 108 are not arranged at constant pitch. This is a case where, for example, the teeth of the guide racks 110 and 111 are arranged at positions corresponding regular medium sizes (A4, A3 or the like), or when the teeth of the guide racks 110 and 111 are arranged at positions corresponding to regular medium sizes and intermediate positions therebetween (i.e., a complex type).

Fourth Embodiment.

Figure 16:
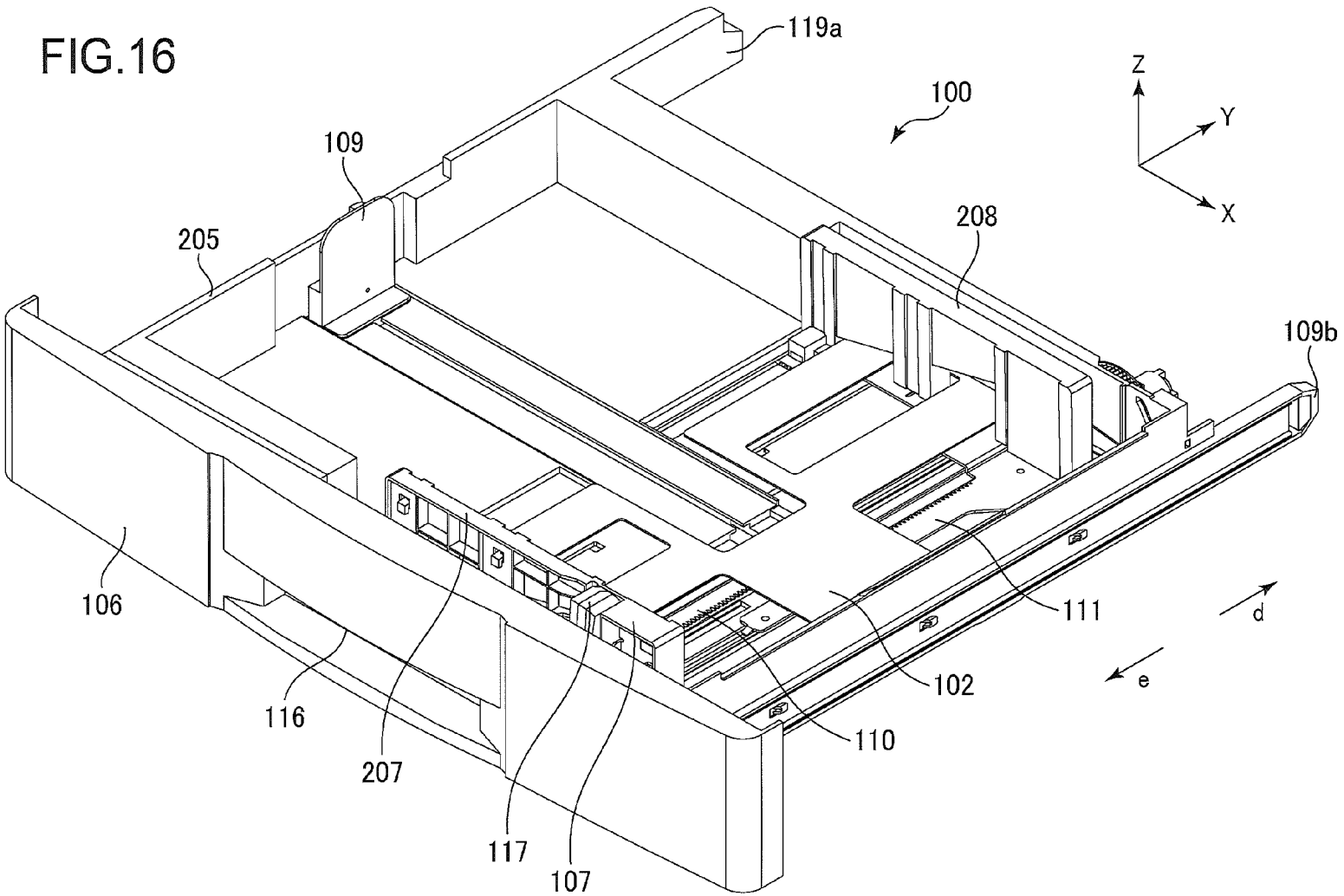
FIG. 16 is a perspective view showing a medium cassette according to the fourth embodiment of the present invention.
Figure 17:
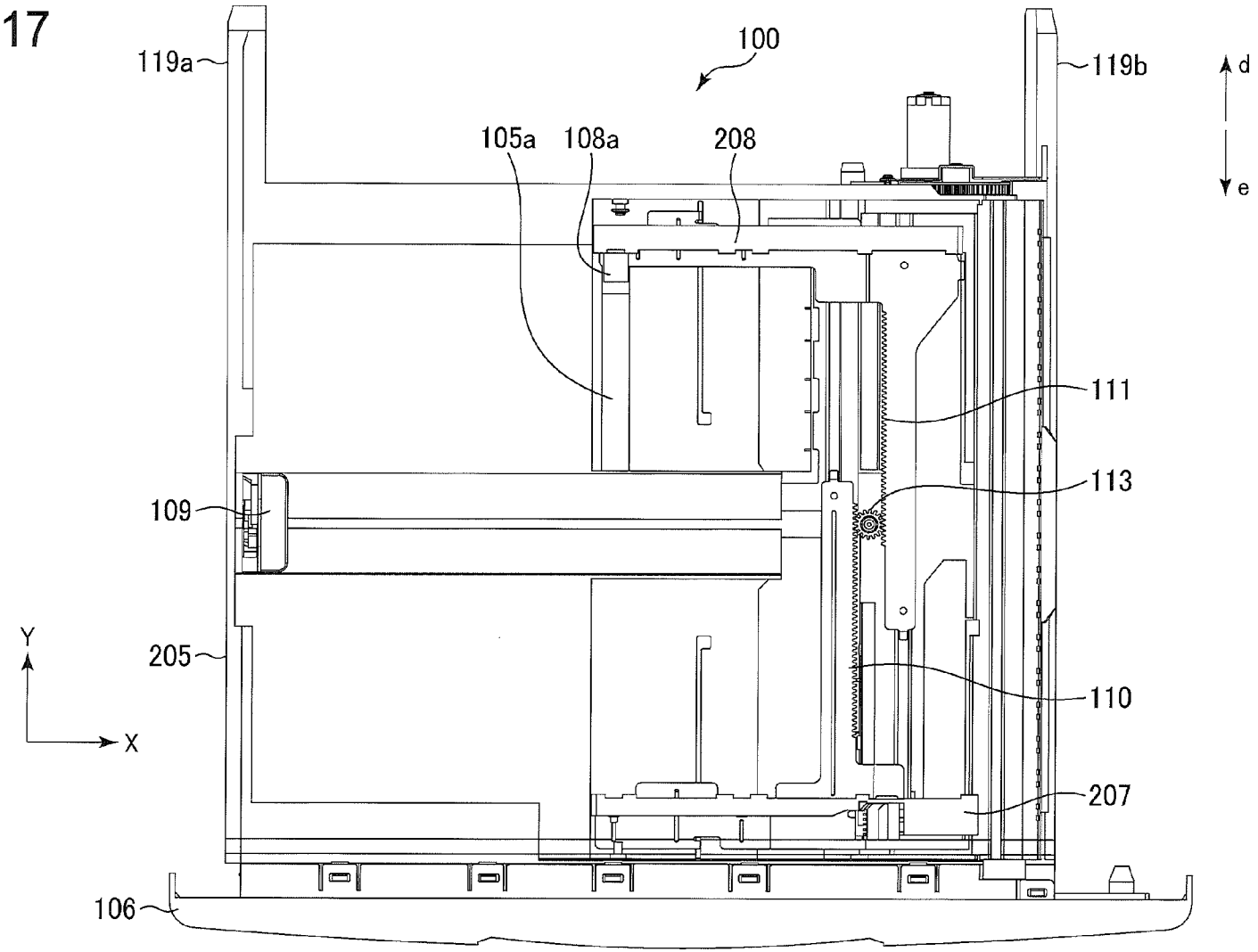
FIG. 17 is a plan view showing the medium cassette according to the fourth embodiment of the present invention.

Next, the fourth embodiment of the present invention will be described. FIGS. 16 and 17 are a perspective view and a plan view showing a medium cassette 100 according to the fourth embodiment. Components that are the same as those of the first embodiment are assigned the same reference numerals. In FIG. 17, the placing plate 102 is omitted.

The medium cassette 100 includes a cassette cover 106 with a handle portion 116 which is gripped by a user upon insertion and removal of the medium cassette 100 into and from the medium feeding apparatus 30 as described in the first embodiment. The medium cassette 100 further includes a medium tray 205 for storing the medium 101 therein, a pair of medium guides 207 and 208 for determining positions of both ends of the medium 101 in the widthwise direction, and a placing plate 102 on which a stack of the media 101 is placed.

Guide racks 110 and 111 are formed on the lower end of the medium guides 207 and 208. The guide racks 110 and 111 extend inwardly in the Y-direction. As described in the first embodiment, the pinion gear 113 is provided between the guide racks 110 and 111. The pinion gear 113 engages both of the guide racks 110 and 111.

Figure 18A:
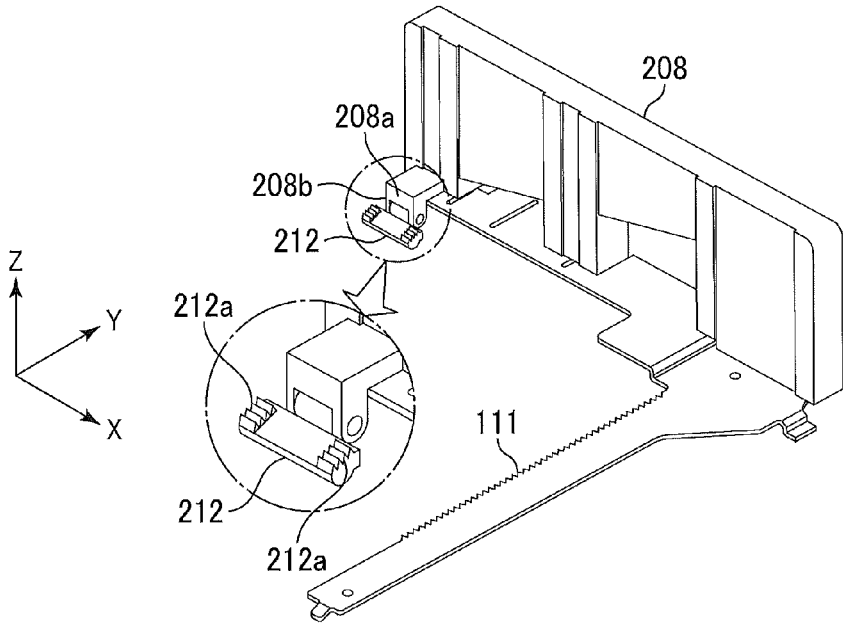
FIG. 18A is a perspective view showing a medium guide according to the fourth embodiment.
Figure 18B:
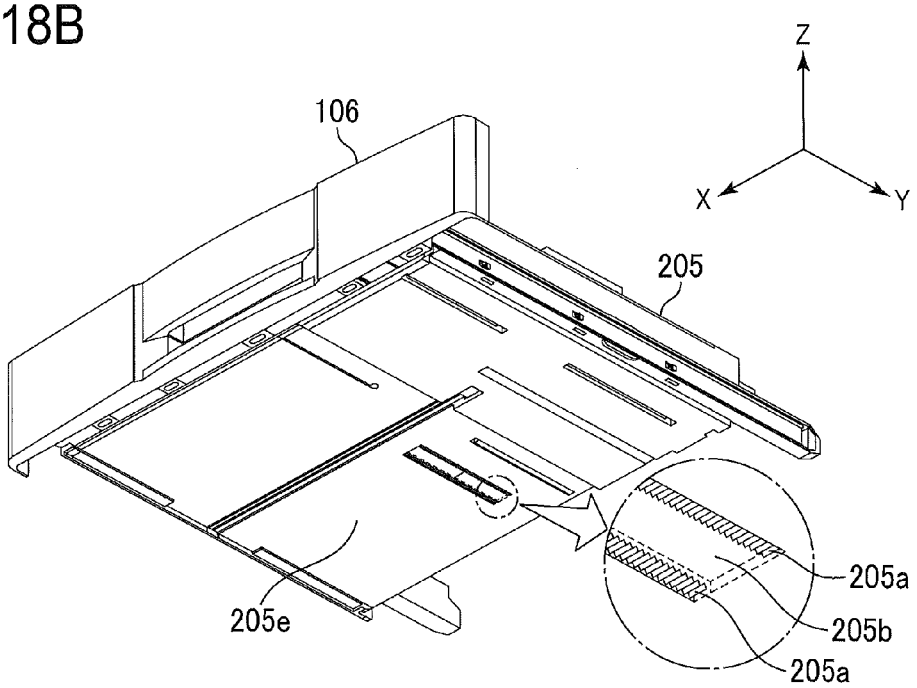
FIG. 18B is a perspective view showing a medium tray according to the fourth embodiment.

FIG. 18A is a perspective view showing the medium guide 208. FIG. 18B is a perspective view showing the medium tray 205. As shown in FIG. 18A, an arm portion 208*a* (i.e., a mounting portion) is formed on an end of the medium guide 208 in the X-direction. The arm portion 208 is located on an upstream end along the feeding direction of the medium 101. The arm portion 208*a* protrudes from an inner side surface of the medium guide 208 in the Y-direction. A lock piece (i.e., a swingable body) 212 is provided on a lower end of the arm portion 208*a*. The lock piece 212 is swingable about a swinging axis 208*b* extending in the X-direction. The lock piece 212 corresponds to an engaging portion (i.e., a third engaging portion or a locking unit).

The lock piece 212 has a pair of claw portions 212*a* as locking portions. The claw portions 212*a* are provided on both ends of the lock piece 212 in the X-direction. Each claw portion 212*a* has a plurality of claws arranged in a radial direction (i.e., a direction of a rotation radius) about the swinging axis 208*b*.

As shown in FIG. 18B, a slit 205*b* is formed on the bottom plate portion (i.e., a tray bottom portion) 205*e* of the medium tray 205. The slit 205*b* extends in the Y-direction. The arm portion 208*a* (FIG. 18A) of the medium guide 208 is inserted into the slit 205*b*. Claw portions 205*a* are formed on both sides of the slit 205*b*. The claw portions 205*a* extend in a longitudinal direction (i.e., the Y-direction) of the slit 205*b*. The claw portions 205*a* correspond to a fourth engaging portion. The claw portions 205*a* are formed on a lower surface of the tray bottom portion 205*e*, and are engageable with the claw portions 212*a* of the lock piece 212.

Figure 19:
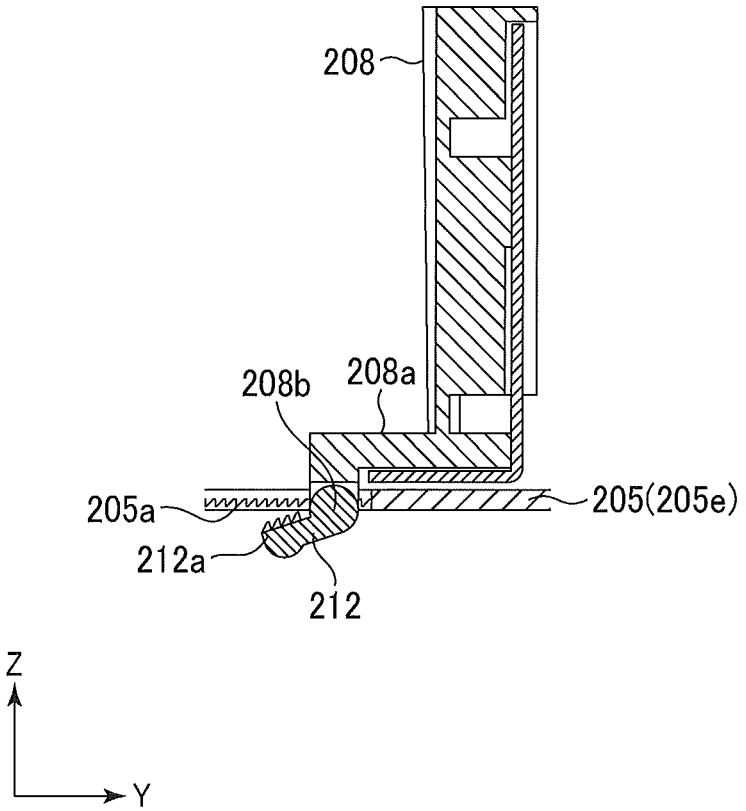
FIG. 19 is a sectional view showing a relationship between the medium guide and the medium tray according to the fourth embodiment.

FIG. 19 is a sectional view in the YZ-plane showing an engagement between the medium guide 208 and the medium tray 205. The arm portion 208*a* of the medium guide 208 is inserted into the slit 205*b* of the medium tray 205. The lock piece 212 is swingable about the swinging axis 208*b*. The claw portions 212*a* of the lock piece 212 are engageable with the claw portions 205*a* of the medium tray 205.

A swinging range of the lock piece 212 has a lower end position and an upper end position. In the lower end position, the claw portions 212*a* are apart from the claw portions 205*a* of the tray bottom portion 205*e* by a predetermined angle as shown in FIGS. 18A and 19. In the upper end position, the claw portions 212 engage the claw portions 205*a* of the tray bottom portion 205*e*.

Figure 20B:
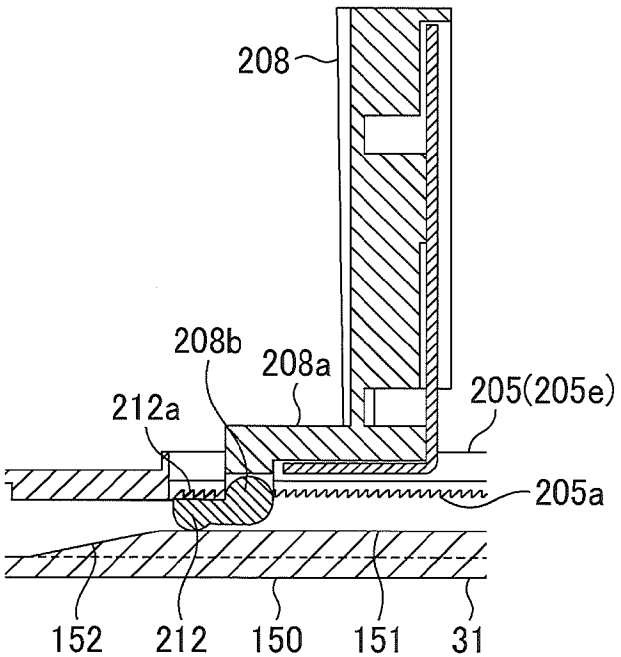
FIG. 20B is a sectional view showing a state where the medium cassette is fully inserted into the main body of the medium feeding apparatus according to the fourth embodiment.
Figure 20A:
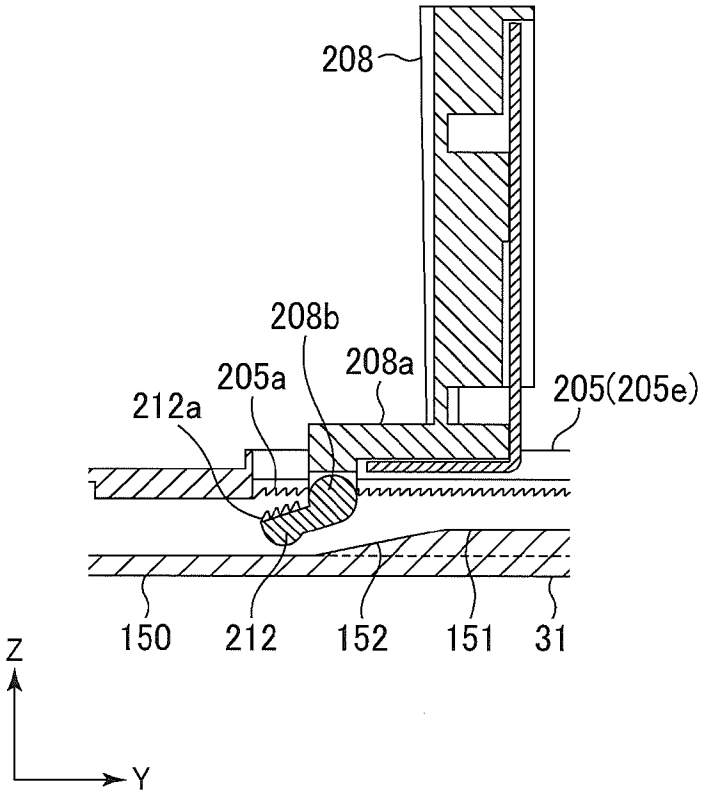
FIG. 20A is a sectional view showing a state where the medium cassette is inserted halfway into a main body of a medium feeding apparatus according to the fourth embodiment.

FIG. 20A is a sectional view in the YZ-plane showing a state where the medium cassette 100 is inserted halfway into the main body 31 of the medium feeding apparatus 30. FIG. 20B is a sectional view in the YZ-plane showing a state where the medium cassette 100 is fully (completely) inserted into the main body 31 of the medium feeding apparatus 30. As described in the first embodiment, the rib 151 is formed on the main body bottom portion 150 of the main body 31 of the medium feeding apparatus 30. The rib 151 is disposed so as to correspond to the lock piece 212. The rib 151 includes the slope portion 152.

The rib 151 has a predetermined height and extends in the Y-direction. As described below, when the medium cassette 100 is inserted into a predetermined position in the medium feeding apparatus 30, the rib 151 contacts the lock piece 212 from below. The rib 151 keeps contacting the lock piece 212. This state continues to a state where the medium cassette 100 is fully inserted into the main body 31 of the medium feeding apparatus 30.

As shown in FIG. 20A, in a state where the medium cassette 100 is inserted halfway into the main body 31 of the medium feeding apparatus 30 but does not reach the predetermined position, the lock piece 212 is at the lower end position of the swinging range. In other words, the lock piece 212 hangs by action of gravity. In this state, the claw portions 212*a* of the lock piece 212 are apart from the claw portions 205*a* of the tray bottom portion 205*e* of the medium cassette 205. In contrast, when the medium cassette 100 reaches the predetermined position in the main body 31 of the medium feeding apparatus 30, the lock piece 212 contacts the rib 151 and is pushed upward as shown in FIG. 20B. In this state, the claw portions 212*a* of the lock piece 212 engage the claw portions 205*a* of the medium cassette 205.

In this regard, the lock lever 117 (FIG. 16) provided on the medium guide 207 has the same configuration as the lock lever 117 (FIG. 3) of the first embodiment. Other configurations are the same as those of the first embodiment.

Next, the insertion and removal of the medium cassette 100 according to the fourth embodiment will be described with reference to FIGS. 20A and 20B.

Before the medium cassette 100 is inserted into the main body 31 of the medium feeding apparatus 30, the lock piece 212 is in the lower end position as shown in FIG. 20A. The claw portions 212*a* of the lock piece 212 are apart from the claw portions 205*a* of the medium tray 205. In this state, the medium guides 207 and 208 can be operated using the lock lever 117.

Figure 21A:
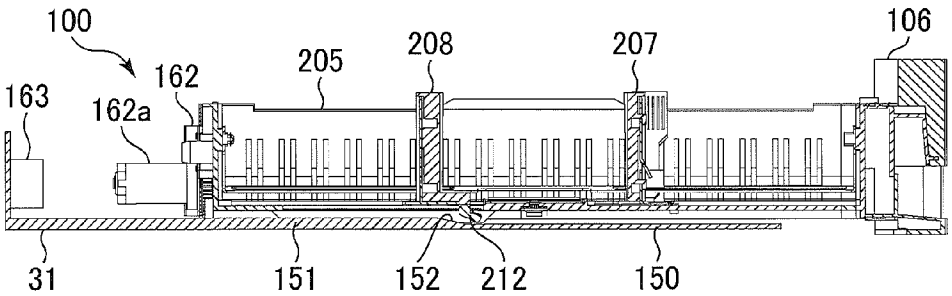
FIGS. 21A through 21F are sectional views for illustrating an insertion operation of the medium cassette into the main body of the medium feeding apparatus according to the fourth embodiment.
Figure 21B:
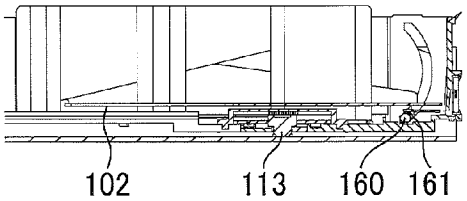
Figure 21C:
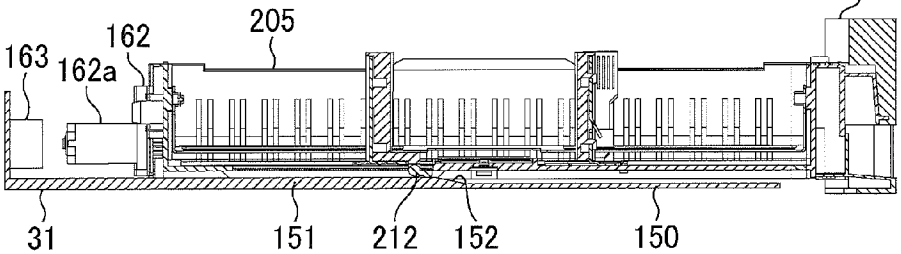
Figure 21D:
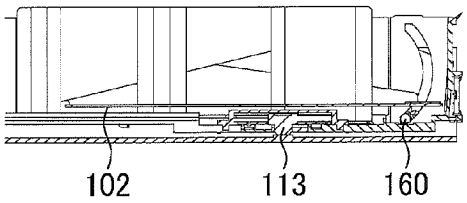
Figure 21E:
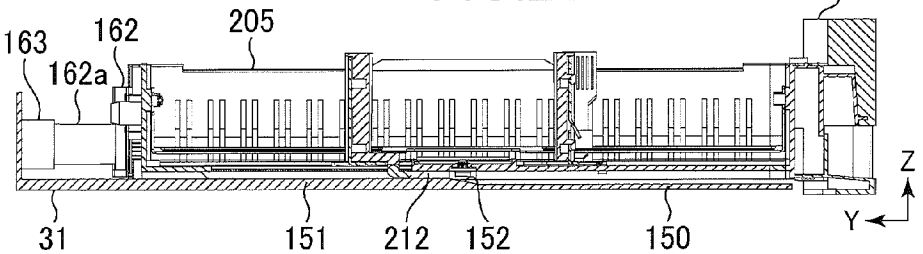
Figure 21F:
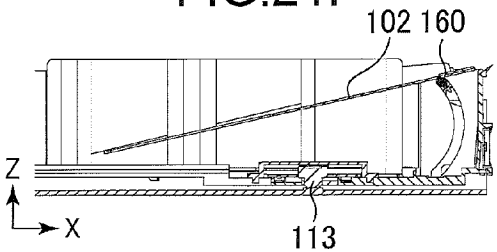

FIGS. 21A and 21B are sectional views respectively in the YZ-plane and the XZ-plane showing a state where the medium cassette 100 is inserted halfway into the main body 31 of the medium feeding apparatus 30. FIGS. 21C and 21D are sectional views respectively in the YZ-plane and the XZ-plane showing a state where the medium cassette 100 is further inserted into the main body 31 of the medium feeding apparatus 30. FIGS. 21E and 21F are sectional views respectively in the YZ-plane and the XZ-plane showing a state where the medium cassette 100 is fully inserted into the main body 31 of the medium feeding apparatus 30.

Upon insertion of the medium cassette 100 into the medium feeding apparatus 30, the user grips the handle portion 116 provided on the cassette cover 106 (FIG. 16), and pushes the medium cassette 100 in the insertion direction (shown by the arrow "d") into the main body 31 of the medium feeding apparatus 30.

As the medium cassette 100 is inserted into the main body 31, the lock piece 212 moves along the slope portion 152, and reaches onto the rib 151 (having the predetermined height) as shown in FIG. 9C. The lock piece 212 is pushed upward by the rib 151 and swings upward to the upper end position. Therefore, the claw portions 212*a* of the lock piece 212 engage the claw portions 205*a* of the medium cassette 205.

In the state where the lock piece 212 is pushed upward and the claw portions 212*a* engage the claw portions 205*a* of the medium cassette 205, the medium guide 208 (to which the lock piece 212 is mounted) is locked with respect to the medium tray 205 so that the medium guide 208 does not move. In other words, the medium guide 208 is locked with respect to the medium tray 205 (i.e., the movement of the medium guide 208 is locked) in a state where medium cassette 100 is inserted halfway into the main body 31. Further, since the movement of the medium guide 207 is coupled with the movement of the medium guide 208 via the pinion gear 113 (FIG. 17) and the like, the medium guide 207 is locked with respect to the medium guide 205 so that the medium guide 207 does not move.

Then, the cassette 100 is further inserted into the main body 31 in a state where the lock piece 212 is pushed upward by the rib 151. As a result, the cassette 100 is fully inserted into the main body 31 of the medium feeding apparatus 30 (FIG. 9E). That is, the insertion of the medium cassette 100 is completed.

During the insertion of the medium cassette 100, the lock piece 212 is kept being pushed upward by the rib 151 of the main body bottom portion 150, and therefore the claw portions 212*a* of the lock piece 212 do not separate from the claw portions 205*a* of the medium tray 205. Therefore, the medium guides 207 and 208 do not move.

As described in the first embodiment, in a state where the medium cassette 100 is fully inserted into the main body 31 of the medium feeding apparatus 30, the connection portion 162*a* of the lift-up gear 162 provided on the medium cassette 100 engage the driving gear 163 provided in the medium feeding apparatus 30 as shown in FIG. 9E. The driving gear 163 is driven by the motor 104 (FIG. 1) to rotate. The rotation of the driving gear 163 causes the lift-up gear 162 to rotate, which causes the placing plate 102 to swing upward as shown FIG. 9F.

As described above, the lock piece 212 is pushed upward by the rib 151 of the main body bottom portion 150, and the claw portions 212*a* of the lock piece 212 engage the claw portions 205*a* of the medium tray 205 to lock the movement of the medium guide 207 and 208 when the medium cassette 100 reaches the predetermined position in the main body 31 of the medium feeding apparatus 30 (FIG. 9C).

Therefore, it becomes possible to prevent displacement of the medium guides 207 and 208 resulted from an impact upon insertion of the medium cassette 100 or an inertia force of the medium 101. In this regard, the locking of the medium guides 207 and 208 is performed in a state where the medium cassette 100 is almost fully inserted into the main body 31, and therefore it is not necessary for a user to operate the medium guides 207 and 208.

As described above, according to the fourth embodiment, the movements of the medium guides 207 and 208 are locked by the lock piece 212 when the medium cassette 100 is inserted halfway into the main body 31 of the medium feeding apparatus 30. Therefore, it becomes possible to prevent displacement of the medium guides 207 and 208 resulted from an impact upon insertion of the medium cassette 100 or an inertia force of the medium 101. Accordingly, it becomes possible to prevent a skew and displacement of the medium 101.

Here, an operation when the claw portions 212*a* of the lock piece 212 do not engage the claw portions 205*a* of the medium tray 205 will be described.

Figure 22A:
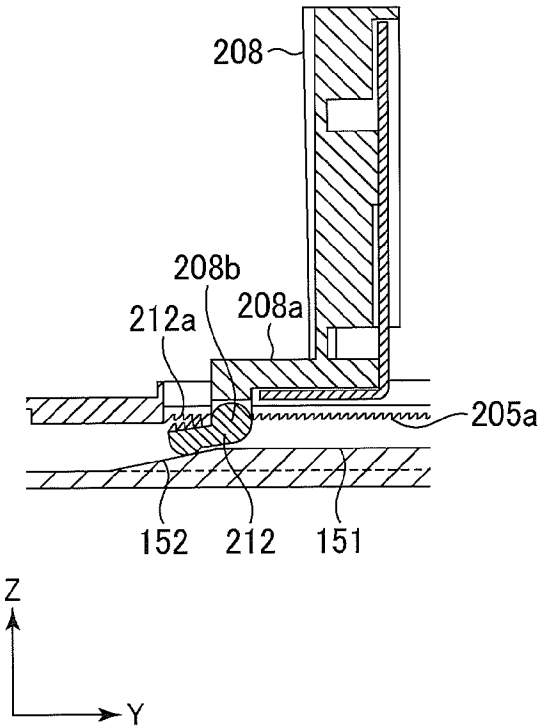
FIGS. 22A, 22B and 22C are sectional views showing an operation in the case where a claw portion of a lock piece does not engage a claw portion of a medium tray according to the fourth embodiment.
Figure 22B:
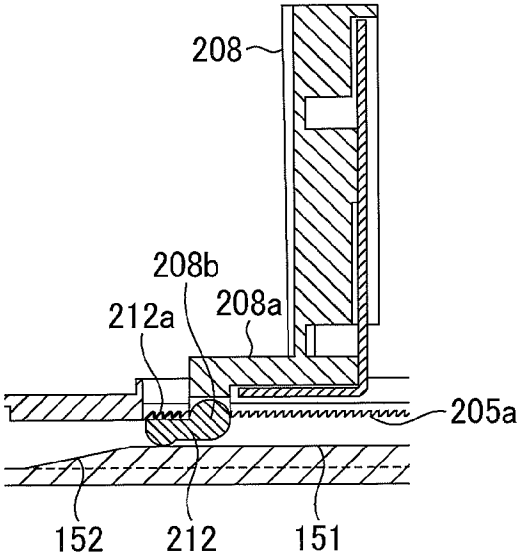
Figure 22C:
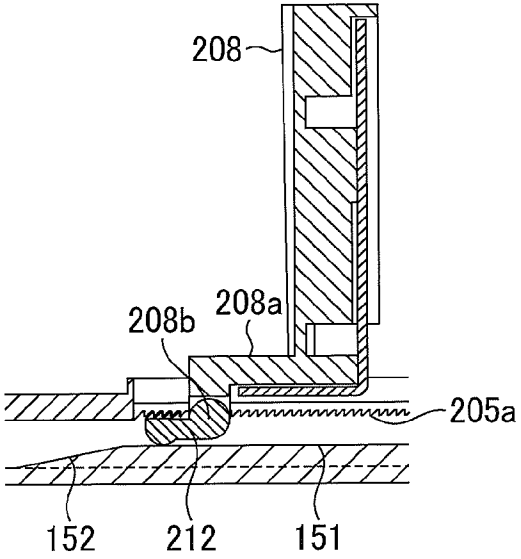

FIG. 22A shows a state where tips of the claw portions 212*a* of the lock piece 212 abut against tips of the claw portions 205*a* of the medium cassette 205. If the medium cassette 100 is inserted into the main body 31 in this state, the claw portions 212*a* of the lock piece 212 and the claw portions 205*a* of the medium cassette 205 may engage each other as shown in FIG. 22B, or may engage each other as shown in FIG. 22C. In other words, there are two possibilities.

However, the claw portions 212*a* of the lock piece 212 and the claw portions 205*a* of the medium tray 205 are arranged at a relatively fine pitch in a range from 0.5 mm to 1.0 mm. Therefore, an engaging manner of the claw portions 212*a* of the lock piece 212 and the claw portions 205*a* of the medium tray 205 does not impair the function of the medium guides 207 and 208 (i.e., the function to determine positions of both ends of the medium 101 in the widthwise direction).

Modification.

Figure 23A:
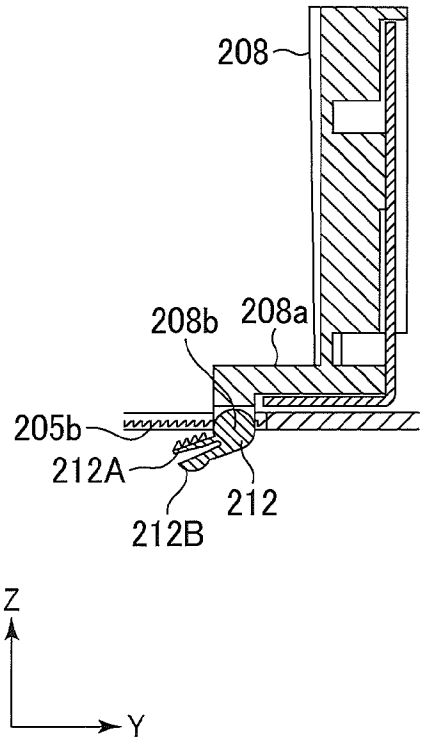
FIGS. 23A, 23B and 23C are sectional views showing a configuration and operation of a lock piece according to a modification of the fourth embodiment.
Figure 23B:
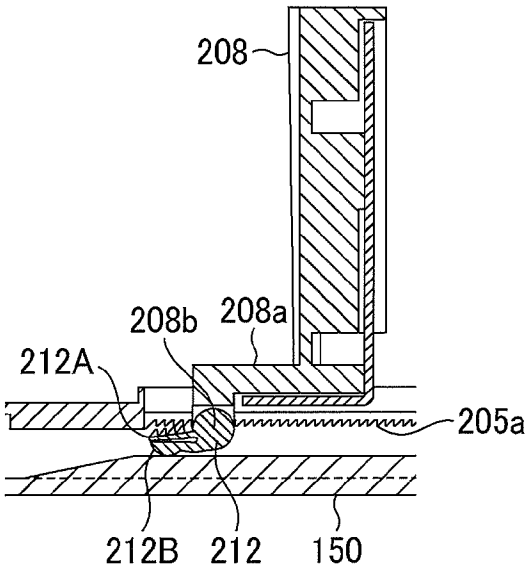
Figure 23C:
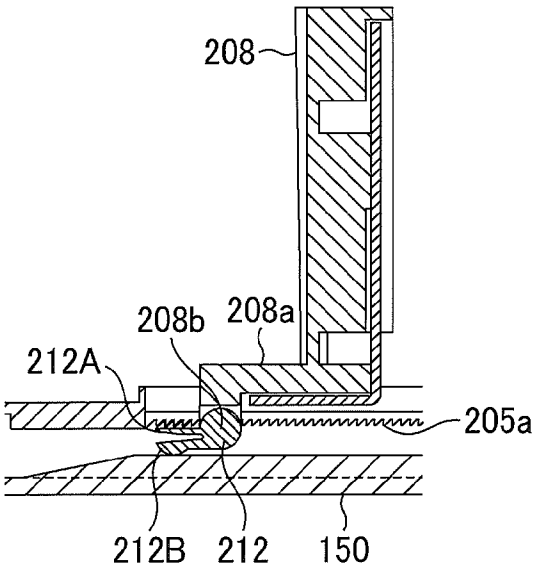

FIGS. 23A, 23B and 23C show a modification of the fourth embodiment. The modification is intended to prevent impact between the tips of the claw portions 212*a* of the lock piece 212 and the claw portions 205*a* of the medium tray 205. As shown in FIG. 23A, the lock piece 212 of the modification includes claw portions 212A (i.e., an engagement portion) engageable with the claw portions 205*a* of the medium tray 205, and a resilient portion 212B (i.e., a biasing portion) that contacts the rib 151 of the bottom portion 151 of the medium feeding apparatus 30. The resilient portion 212B is composed of, for example, resin. An angle between the claw portions 212A and the resilient portion 212B about the swinging axis of the lock piece 212 changes as shown in FIG. 23B and FIG. 23C.

As shown in FIG. 23B, when the tips of the claw portions 212A of the lock piece 212 contact the tips of the claw portions 205*a* of the medium tray 205, the resilient portion 212B resiliently deforms. The impact between the tips of the claw portions 212A of the lock piece 212 and the tips of the claw portions 205*a* of the medium tray 205 is absorbed by the resilient deformation of the resilient portion 212B. Therefore, the claw portions 212A of the lock piece 212 and the claw portions 205*a* of the medium tray 205 smoothly transit to a state where the claw portions 212A engage the claw portions 205*a* as shown in FIG. 23C.

In this regard, the resilient member 212B can be formed of a resilient body such as resin. However, if the resilient member 212B is kept being resiliently deformed for a long time period as shown in FIG. 23B, resin may be subjected to plastic deformation (creep). Therefore, it is also possible to provide a biasing member such as a metal coil spring or a stainless plate spring to push the claw portions 212A toward the claw portions 205*a*.

Fifth Embodiment.

Figure 24A:
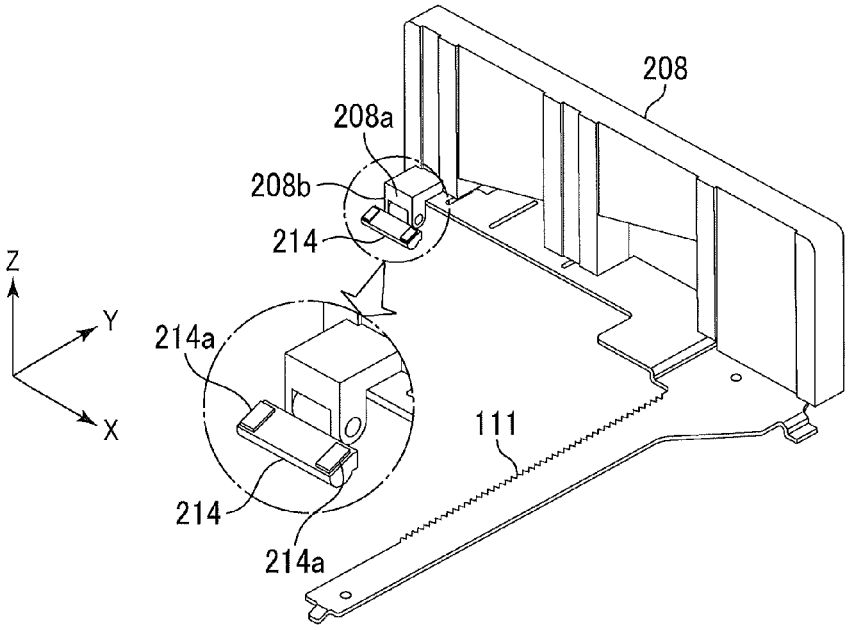
FIG. 24A is a perspective view showing a medium guide of a medium cassette according to the fifth embodiment of the present invention.
Figure 24B:
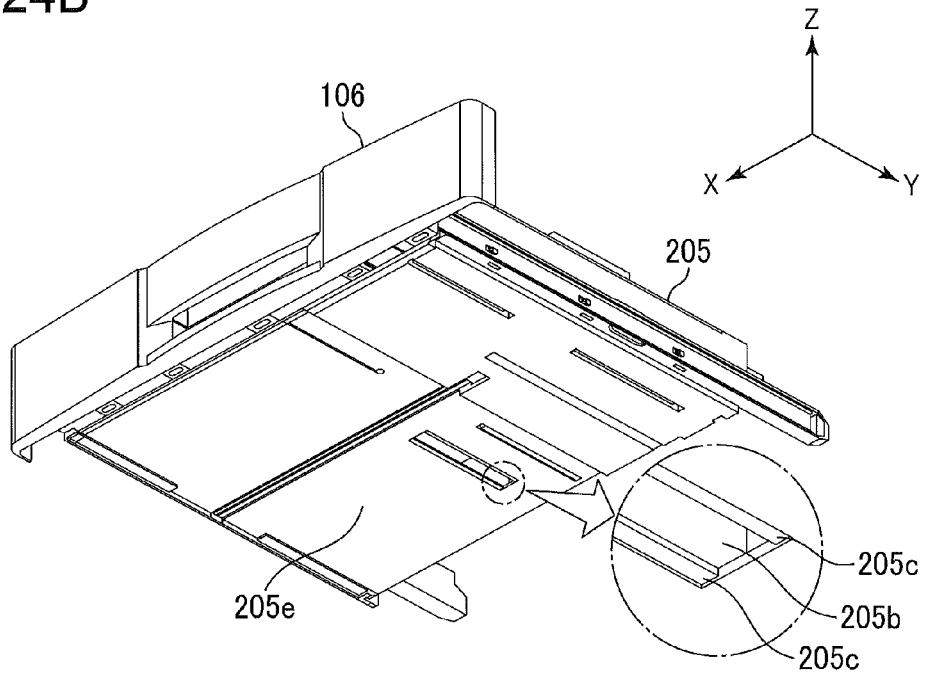
FIG. 24B is a perspective view showing a medium tray of the medium cassette according to the fifth embodiment of the present invention.

Next, the fifth embodiment of the present invention will be described. FIG. 24A is a perspective view showing the medium cassette 208 of the medium cassette 100 according to the fifth embodiment. FIG. 24B is a perspective view showing the medium tray 205. Components that are the same as those of the fourth embodiment are assigned the same reference numerals.

As shown in FIG. 24A, a lock piece 214 (i.e., a locking unit or an engaging member) of the fifth embodiment is provided on the arm portion 208*a* of the medium guide 208. The lock piece 214 is swingable about the swinging axis 214*b* extending in the X-direction. A pair of friction contact portions 214*a* (i.e., lock portions) are provided on both ends of the lock piece 214 in the X-direction. That is, the lock piece 214 has the friction contact portions 214*a* instead of the claw portions 212*a* (FIG. 18A) of the lock piece 212 of the fourth embodiment.

Each friction contact portion 214*a* is made of a resilient body having a certain thickness, and has a high friction surface. In other words, the friction contact portion 214*a* is made of a high friction member. The friction contact portion 214*a* can be formed of a rubber piece composed of, for example, NBR (Nitrile Butadiene Rubber). The friction contact portion 214*a* can also be formed of a plate spring to which a urethane film is bonded.

As shown in FIG. 24B, the slit 205*b* is formed on the tray bottom portion 205*e* of the medium tray 205 as described in the fourth embodiment. The slit 205*b* extends in the Y-direction. A pair of contact surfaces 205*c* (i.e., fourth engaging portions) are formed on both sides of the slit 205*b* in the widthwise direction. The contact surfaces 205*c* extend in a longitudinal direction of the slit 205*b*. The contact surfaces 205*c* are formed so as to face downward of the tray bottom portion 205*e*. Other configurations are the same as those of the first embodiment.

Figure 25B:
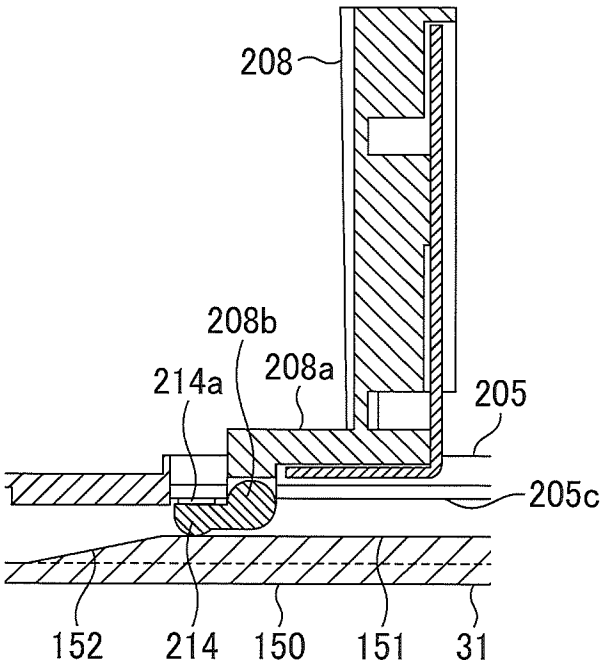
FIG. 25B is a sectional view showing a state where the medium cassette is fully inserted into the main body of the medium feeding apparatus according to the fifth embodiment.
Figure 25A:
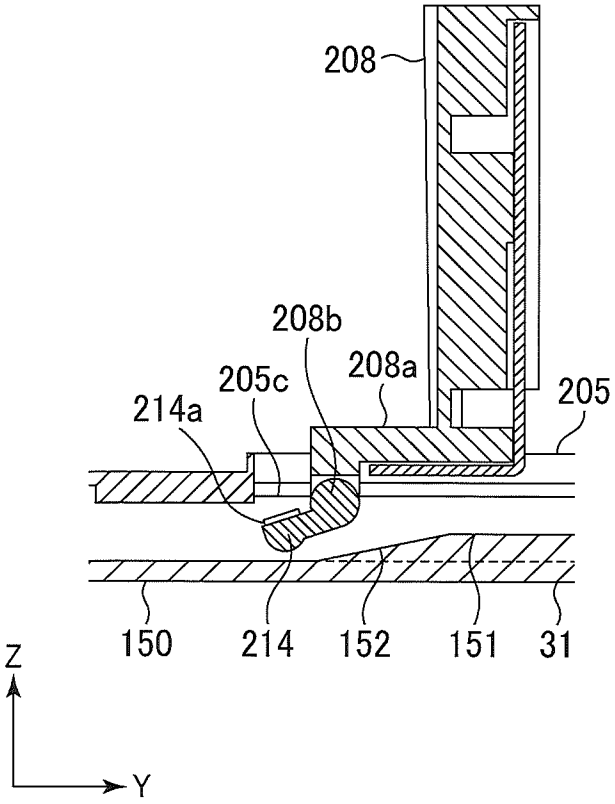
FIG. 25A is a sectional view showing a state where the medium cassette is inserted halfway into a main body of a medium feeding apparatus according to the fifth embodiment.

FIG. 25A shows a state where the medium cassette 100 is inserted halfway into the main body 31 of the medium feeding apparatus 30. FIG. 25B shows a state where the medium cassette 100 is further inserted into the main body 31 of the medium feeding apparatus 30.

As shown in FIG. 25A, in a state where the medium cassette 100 is inserted into the main body 31 of the medium feeding apparatus 30 but does not reach a predetermined position, the lock piece 214 is in the lower end position of the movable range. The friction contact portions 214*a* of the lock piece 214 are apart from the contact surfaces 205*c* of the medium tray 205. In this state, movements of the medium guides 207 and 208 are not locked.

In contrast, as shown in FIG. 25B, when the medium cassette 100 reaches the predetermined position in the main body 31 of the medium feeding apparatus 30, the lock piece 214 is pushed upward by the rib 151 (including the slope portion 152) formed on the main body bottom portion 150 of the medium feeding apparatus 30. The friction contact portions 214*a* of the lock piece 214 are pressed against the contact surfaces 205*c* of the medium tray 205.

The friction contact portions 214*a* of the lock piece 214 are slightly compressed, and generate repulsion force (i.e., resilient force), so that friction force is generated between the friction contact portions 214*a* and the contact surfaces 205*c*. In this state, the movement of the medium guide 208 is locked. Further, since the movement of the medium guide 207 is coupled with the movement of the medium guide 208 via the pinion gear 113 (FIG. 17) and the like, the movement of the medium guide 207 is locked.

As described above, according to the fifth embodiment of the present invention, the movements of the medium guides 207 and 208 are locked by the friction force between the friction contact portions 214*a* of the lock piece 214 and the contact surfaces 205*c* of the medium tray 205. Therefore, the medium guides 207 and 208 can be locked at arbitrary positions. Further, fine displacement (FIG. 22) of the medium guides 207 and 207 described in the fourth embodiment can be prevented.

In this embodiment, the lock piece 214 has the friction contact portions 214*a* (made of high friction material) that contact the contact surfaces 205*c* of the medium tray 205. However, it is also possible that the contact surfaces 205*c* of the medium tray 205 has a friction contact portion (made of high friction material) that contacts a surface of the lock piece 214 provided with no friction contact portion.

Sixth Embodiment.

Figure 26B:
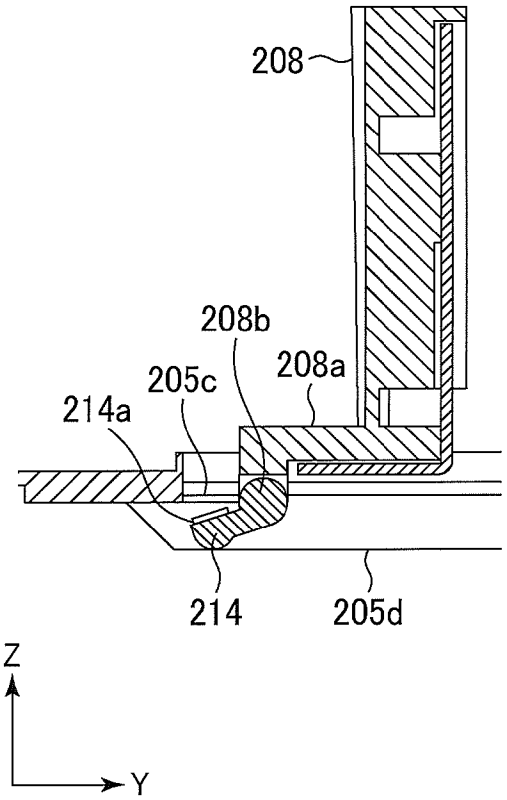
FIG. 26B is a sectional view showing a state where the medium cassette is inserted halfway into a main body of a medium feeding apparatus according to the sixth embodiment of the present invention.
Figure 26A:
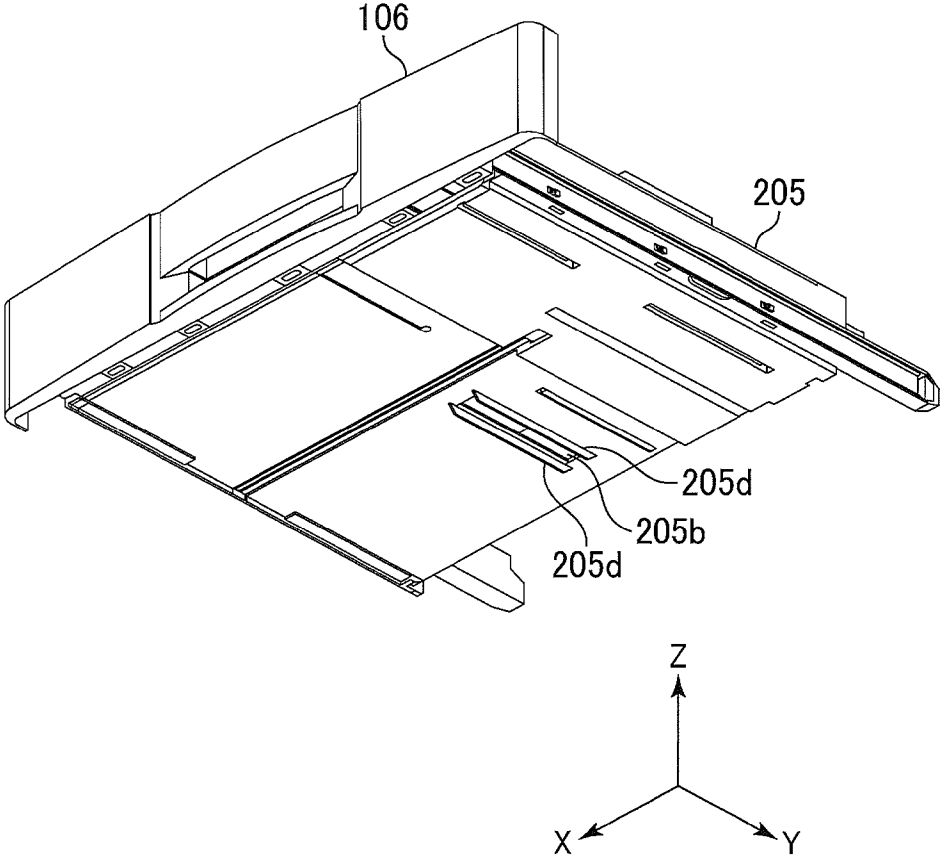
FIG. 26A is a perspective view showing a medium tray of a medium cassette according to the sixth embodiment of the present invention.

Next, the sixth embodiment of the present invention will be described. FIG. 26A is a perspective view showing the medium tray 205 according to the sixth embodiment. FIG. 26B is a sectional view showing a state where the medium cassette 100 is inserted into the main body 31 of the medium feeding apparatus 30 to reach the predetermined position. Components that are the same as those described in the fifth embodiment are assigned the same reference numerals.

As shown in FIG. 26A, a pair of guide ribs 205*d* are formed on both sides of the slit 205*b* of the medium tray 205 in the sixth embodiment. The guide ribs 205*d* extend along the longitudinal direction of the slit 205*b*. The guide ribs 205*d* protrude downward from the tray bottom portion 205*e*. As shown in FIG. 26B, the guide ribs (i.e., guide members) 205*d* are configured to contact both end portions (FIG. 24A) of the lock piece 214 in the X-direction from below. In other words, the guide ribs 205*d* hold the lock piece 214 so that the lock piece 214 does not protrude downward from the guide ribs 205*d*.

In order not to interfere with the contact between the lock piece 215 and the rib 151 of the main body bottom portion 150 of the medium feeding apparatus 30, the guide ribs 205*d* are not provided on a position (i.e., a center position in the X-direction) facing the rib 151.

With such a configuration, the lock piece 214 is prevented from being unintentionally pushed when the medium cassette 100 is inserted into or removed from the main body 31 of the medium feeding apparatus 30, or when the medium guides 207 and 208 operated while the medium cassette 100 (removed from the main body 31) is placed on a table or the like.

As described above, according to the sixth embodiment of the present invention, the guide ribs 205*d* are provided for holding the lock piece 214, and therefore unintentional locking of the movement of the guide members 207 and 208 can be prevented. Therefore, operability can be enhanced.

It is also possible to provide the guide ribs 205*d* on both sides of the slit 205*b* (FIG. 18B) of the medium tray 205 described in the fourth embodiment.

The first through sixth embodiments and modifications thereof can be appropriately combined.

Further, in the first through sixth embodiments and modifications thereof, descriptions have been made of the medium feeding apparatus provided in the printer as the image forming apparatus. However, the present invention is not limited to such a configuration. For example, the present invention is also applicable to a configuration in which a medium cassette is directly inserted into (i.e., mounted to) and removed from (i.e., detached from) a main body of an image forming apparatus.

Furthermore, in the first through sixth embodiments and modifications thereof, the image forming portion 410 includes the process unit 430K, 430Y, 430M and 430C of black, yellow, magenta and cyan (i.e., four colors). However, the number of colors, the number and positions of process units and an image forming system are not limited to those described in the embodiments.

The first through sixth embodiments are particularly advantageous in a medium feeding apparatus where the insertion/removal direction of the medium cassette is parallel to a movable direction of the medium guides. In a general medium feeding apparatus of such type, a tooth jumping may occur between the pinion gear and the guide racks, and the medium guides may be unintentionally displaced, with the result that the medium (guided by the medium guides) may also be displaced. Further, if the medium guides are displaced, a gap may be formed between the medium and the medium guides, with the result that a skew of the medium may occur.

However, according to the first through sixth embodiments (and modifications thereof) described above, the medium guides can be prevented from being unintentionally displaced. Thus, positioning accuracy of the medium can be enhanced, and a skew of the medium can be prevented.

While the preferred embodiments of the present invention have been illustrated in detail, it should be apparent that modifications and improvements may be made to the invention without departing from the spirit and scope of the invention as described in the following claims.

What is claimed is:

1. A medium feeding apparatus comprising:

an apparatus main body; and a medium cassette removably inserted into the apparatus main body, the medium cassette being configured to store a medium in a medium placing region;

wherein the medium cassette includes:

a medium positioning unit that determines a position of the medium; and a locking unit that locks a movement of the medium positioning unit when the medium cassette is inserted into the apparatus main body and before the medium cassette reaches a first predetermined position in the apparatus main body;

wherein the apparatus main body includes a contacting section that faces a bottom surface of the medium cassette in the medium placing region when the medium cassette reaches a second predetermined position in the apparatus main body;

wherein the locking unit locks the medium positioning unit by contacting the contacting section; and wherein the medium cassette has a hole through which the locking unit protrudes downward from the medium cassette.

2. The medium feeding apparatus according to claim 1, wherein the contacting section includes a slope portion that is inclined with respect to a bottom portion of the medium cassette.

3. The medium feeding apparatus according to claim 1, wherein:

the medium positioning unit includes a medium guide movably provided on the medium cassette; and the locking unit locks a movement of the medium guide.

4. An image forming apparatus comprising:

the medium feeding apparatus according to claim 1; and an image forming portion that forms an image on the medium fed by the medium feeding apparatus.

5. The medium feeding apparatus according to claim 1, wherein the medium cassette has a guide portion provided along the hole, the guide portion protruding downward from the medium cassette.

6. A medium feeding apparatus comprising:

an apparatus main body; and a medium cassette removably inserted into the apparatus main body, the medium cassette being configured to store a medium;

wherein the medium cassette includes:

a medium positioning unit that determines a position of the medium; and a locking unit that locks a movement of the medium positioning unit when the medium cassette is inserted into the apparatus main body and before the medium cassette reaches a first predetermined position in the apparatus main body;

wherein the apparatus main body includes a contacting section provided so that the contacting section faces the medium cassette when the medium cassette reaches a second predetermined position in the apparatus main body;

wherein the locking unit locks the medium positioning unit by contacting the contacting section;

wherein the medium positioning unit includes a medium guide movably provided on the medium cassette;

wherein the locking unit locks a movement of the medium guide;

wherein the medium guide includes a rack portion;

wherein the medium cassette includes a rotatable pinion gear that engages the rack portion of the medium guide, the pinion gear being movable in an axial direction of the pinion gear and being contactable with the contacting section of the apparatus main body;

wherein the locking unit includes a first engaging portion that engages the pinion gear to thereby lock the movement of the medium guide; and wherein the pinion gear moves toward the first engaging portion by contact with the contacting section.

7. The medium feeding apparatus according to claim 5, wherein:

the medium cassette includes a biasing member that biases the pinion gear in a direction away from the first engaging portion; and the pinion gear has a second engaging portion that engages the first engaging portion when the pinion gear moves toward the first engaging portion resisting a biasing force of the biasing member.

8. The medium feeding apparatus according to claim 7, wherein the first engaging portion and the second engaging portion have convex-and-concave portions that engage each other.

9. The medium feeding apparatus according to claim 8, wherein an arrangement pitch of each of the convex-and-concave portions of the first engaging portion and the second engaging portion is smaller than a pitch of the pinion gear.

10. The medium feeding apparatus according to claim 9, wherein the second engaging portion is provided on an end of the pinion gear in an axial direction thereof.

11. The medium feeding apparatus according to claim 7, wherein the first engaging portion and the second engaging portion have friction contact portions that contact each other.

12. The medium feeding apparatus according to claim 6, wherein the medium cassette has a hole through which the locking unit protrudes downward from the medium cassette.

13. The medium feeding apparatus according to claim 12, wherein the medium cassette has a guide portion provided along the hole, the guide portion protruding downward from the medium cassette.

14. A medium feeding apparatus comprising:

an apparatus main body including an image forming unit that forms an image on the medium; and a medium cassette removably inserted into the apparatus main body, the medium cassette being configured to store a medium;

wherein the apparatus main body includes a contacting section provided so that the contacting section faces the medium cassette when the medium cassette reaches a second predetermined position in the apparatus main body;

wherein the medium cassette includes:

a medium guide movably provided in the medium cassette, the medium guide being configured to determine a position of the medium, the medium guide including a rack portion;

a rotatable pinion gear that is engageable with the rack portion of the medium guide, the pinion gear being movable in an axial direction of the pinion gear; and a locking unit including a first engaging portion that engages the pinion gear to restrict a movement of the medium guide when the medium cassette is inserted into the apparatus main body and before the medium cassette reaches a first predetermined position in the apparatus main body;

wherein when the medium cassette is inserted into the apparatus main body and contacts the contacting section, the locking unit causes the pinion gear to move toward the first engaging portion so as to lock the medium guide to restrict the movement of the medium guide.

15. The medium feeding apparatus according to claim 14, wherein the contacting section includes a slope portion that is inclined with respect to a bottom portion of the medium cassette.

16. The medium feeding apparatus according to claim 14, wherein:

the medium cassette includes a biasing member that biases the pinion gear in a direction away from the first engaging portion; and the pinion gear has a second engaging portion that engages the first engaging portion when the pinion gear moves toward the first engaging portion resisting a biasing force of the biasing member.

17. The medium feeding apparatus according to claim 16, wherein the first engaging portion and the second engaging portion have convex-and-concave portions that engage each other.

18. The medium feeding apparatus according to claim 17, wherein an arrangement pitch of each of the convex-and-concave portions of the first engaging portion and the second engaging portion is smaller than a pitch of the pinion gear.

19. The medium feeding apparatus according to claim 16, wherein the first engaging portion and the second engaging portion have friction contact portions that contact each other.

20. The medium feeding apparatus according to claim 16, wherein the second engaging portion is provided on an end of the pinion gear in an axial direction thereof.

* * * * *